US005657597A

United States Patent [19]

Loftus

[11] Patent Number: 5,657,597

[45] Date of Patent: Aug. 19, 1997

[54] BUILDING CONSTRUCTION METHOD

[75] Inventor: William E. Loftus, Clearwater, Fla.

[73] Assignee: Environmental Building Technology, Ltd., Clearwater, Fla.

[21] Appl. No.: 419,880

[22] Filed: Apr. 11, 1995

[51] Int. Cl.[6] ..... E04C 3/02

[52] U.S. Cl. ..... 52/274; 52/299; 52/294; 52/763; 52/483.1

[58] Field of Search ..... 52/745.05, 480, 52/262, 263, 271, 274, 236.6, 294, 299, 763, 483.1

[56] References Cited

U.S. PATENT DOCUMENTS

| | | | |
|---|---|---|---|
| 1,793,188 | 2/1931 | Noerenberg | 52/262 |
| 2,006,070 | 6/1935 | Di Stasio | 52/483.1 X |
| 2,124,519 | 7/1938 | Piersen et al. | 52/294 |
| 2,160,225 | 5/1939 | Newman | 52/262 |
| 3,427,771 | 2/1969 | Cacossa | 52/483.1 X |
| 3,529,919 | 9/1970 | Tiraspoisky | 114/206 |
| 3,562,979 | 2/1971 | Ali-Oglu | 52/125 |
| 3,600,862 | 8/1971 | Ludwig | 52/236 |
| 3,616,589 | 11/1971 | Sherard | 52/659 |
| 3,625,808 | 12/1971 | Martain | 161/37 |
| 3,638,377 | 2/1972 | Caspe | 52/167 |
| 3,653,170 | 4/1972 | Sheckler | 52/375 |
| 3,783,566 | 1/1974 | Nielson | 52/232 |
| 3,792,560 | 2/1974 | Naylor | 52/364 |
| 3,794,390 | 2/1974 | Kilcher | 308/3 R |
| 3,802,134 | 4/1974 | McCorvey | 52/299 X |
| 3,826,339 | 7/1974 | Brokaw . | |
| 3,846,946 | 11/1974 | Sandstrom | 52/221 |
| 3,853,162 | 12/1974 | Menge | 52/262 X |
| 3,927,498 | 12/1975 | Benedetti | 52/262 X |
| 3,946,529 | 3/1976 | Chevaux | 52/483.1 X |
| 3,979,863 | 9/1976 | Hurley | 52/92 |
| 4,027,439 | 6/1977 | Willerd | 52/299 X |
| 4,058,941 | 11/1977 | Zakrzewski et al. | 52/262 X |
| 4,090,336 | 5/1978 | Carroll | 52/309.7 |
| 4,098,034 | 7/1978 | Howell | 52/1 |
| 4,144,802 | 3/1979 | Bahin | 98/119 |
| 4,223,502 | 9/1980 | Robinson | 52/315 |
| 4,238,137 | 12/1980 | Furchak | 308/3 |
| 4,249,354 | 2/1981 | Wynn | 52/438 |
| 4,278,726 | 7/1981 | Wieme | 428/229 |
| 4,282,692 | 8/1981 | Potthast | 52/236 |
| 4,306,395 | 12/1981 | Carpenter | 52/223 |
| 4,320,602 | 3/1982 | Richardson | 52/1 |
| 4,325,457 | 4/1982 | Docherty | 181/210 |
| 4,363,149 | 12/1982 | Kondo | 14/16.1 |
| 4,371,143 | 2/1983 | Ishida et al. | 248/638 |
| 4,372,089 | 2/1983 | Akesson | 52/404 |
| 4,402,483 | 9/1983 | Kurabayashi | 248/636 |
| 4,409,761 | 10/1983 | Bechtel | 52/1 |

(List continued on next page.)

*Primary Examiner*—Carl D. Friedman
*Assistant Examiner*—W. Glenn Edwards
*Attorney, Agent, or Firm*—Joseph C. Mason, Jr.; Murray B. Baxter; Mason & Associates, P.A.

[57] ABSTRACT

A low cost building is made of modular parts in the absence of special tools. Light-in-weight wall blocks having a facade of conventional appearance include a thick, insulating mixture of a cementitious material, polystyrene, and organic fiber aggregates capable of retaining water. The blocks have interlocking top and bottom surfaces so that they are easily stacked to form walls. A floor is built by spanning foundation beams with floor trusses that have a key along their respective tops and by sliding modular floor panels between contiguous floor trusses, each floor panel having opposite edges that slidingly engage the keys of the floor trusses. A roof is made in a similar manner by sliding modular roof panels between contiguous roof trusses. Tensioning rods are extended from a top surface of the walls to the building foundation to compress the walls. In a second embodiment, channels for receiving electrical wiring and plumbing conduits are formed in the wall panels, and an air conditioning duct is formed by slabs that surmount the walls. Shock absorbing springs positioned between foundation blocks and foundation beams cushion the effect of earthquakes. Door and window openings are framed with special channels that facilitate door and window installation. Cementitious compositions which are useful in the method of the present invention are also disclosed.

5 Claims, 17 Drawing Sheets

U.S. PATENT DOCUMENTS

| | | | |
|---|---|---|---|
| 4,409,765 | 10/1983 | Pall | 52/167 |
| 4,409,766 | 10/1983 | Blackmore | 52/169 |
| 4,443,985 | 4/1984 | Moreno | 52/236 |
| 4,450,659 | 5/1984 | Hanaoka et al. | 52/167 |
| 4,468,908 | 9/1984 | Radtke et al. | 52/483.1 |
| 4,472,916 | 9/1984 | Krebs | 52/236 |
| 4,513,040 | 4/1985 | Lankard | 428/49 |
| 4,514,942 | 5/1985 | Pocanschi | 52/167 |
| 4,514,950 | 5/1985 | Goodson | 52/648 |
| 4,517,780 | 5/1985 | Lacombe | 52/233 |
| 4,525,972 | 7/1985 | Palacio | 52/643 |
| 4,531,334 | 7/1985 | Nylander | 52/109 |
| 4,553,792 | 11/1985 | Reeve | 308/3 |
| 4,587,773 | 5/1986 | Valencia | 52/1 |
| 4,592,671 | 6/1986 | Daum | 403/171 |
| 4,608,790 | 9/1986 | Eberlein | 52/81 |
| 4,630,412 | 12/1986 | Engström | 52/1 |
| 4,635,892 | 1/1987 | Blaker | 248/550 |
| 4,644,714 | 2/1987 | Zayas | 52/167 |
| 4,650,361 | 3/1987 | Seuster | 403/24 |
| 4,661,387 | 4/1987 | Watanabe | 428/36 |
| 4,694,626 | 9/1987 | Nicklas | 52/309 |
| 4,727,695 | 3/1988 | Kemeny | 52/167 |
| 4,766,706 | 8/1988 | Caspe | 52/1 |
| 4,793,105 | 12/1988 | Caspe | 52/167 |
| 4,831,802 | 5/1989 | Cromrich et al. | 52/311 |
| 4,875,313 | 10/1989 | Sato | 52/167 |
| 4,881,350 | 11/1989 | Wu | 52/167 |
| 4,883,250 | 11/1989 | Yano et al. | 248/638 |
| 4,884,382 | 12/1989 | Horobin | 52/426 |
| 4,924,639 | 5/1990 | Sato | 52/167 |
| 4,938,635 | 7/1990 | Russell | 405/252 |
| 4,942,703 | 7/1990 | Nicolai | 52/167 |
| 4,942,707 | 7/1990 | Huettemann | 52/309 |
| 4,967,528 | 11/1990 | Doran | 52/309.12 |
| 4,972,636 | 11/1990 | Noji et al. | 52/167 |
| 4,972,642 | 11/1990 | Strobl | 52/297 |
| 4,986,049 | 1/1991 | Kennedy et al. | 52/309.12 |
| 5,014,474 | 5/1991 | Fyfe | 52/167 |
| 5,019,170 | 5/1991 | Walter | 106/805 |
| 5,020,290 | 6/1991 | Hajjar | 52/242 |
| 5,024,035 | 6/1991 | Hanson | 52/591 |
| 5,040,344 | 8/1991 | Durand | 52/127.2 |
| 5,054,251 | 10/1991 | Kemeny | 52/167 |
| 5,058,338 | 10/1991 | Clampi | 52/167 |
| 5,074,086 | 12/1991 | Noji et al. | 52/167 |
| 5,107,634 | 4/1992 | Onoda et al. | 52/167 |
| 5,150,552 | 9/1992 | Davis-Arzac | 52/259 |
| 5,174,080 | 12/1992 | Yoshimuri | 52/252 |
| 5,177,915 | 1/1993 | Kobori et al. | 52/167 |
| 5,181,356 | 1/1993 | Sul | 52/167 |
| 5,182,888 | 2/1993 | Miyamoto | 52/167 |
| 5,187,905 | 2/1993 | Porurtau | 52/144 |
| 5,205,097 | 4/1993 | Harvey | 52/294 |
| 5,230,191 | 7/1993 | Mayrand | 52/309.12 |
| 5,233,797 | 8/1993 | Unn et al. | 32/1 |
| 5,245,807 | 9/1993 | Ishimaru et al. | 52/167 |
| 5,249,889 | 10/1993 | Sierzega | 405/128 |
| 5,253,460 | 10/1993 | Simenoff | 52/252 |
| 5,255,764 | 10/1993 | Kurabayashi | 188/380 |
| 5,261,198 | 11/1993 | McMillan | 52/127 |
| 5,265,972 | 11/1993 | Bahr | 403/252 |
| 5,267,420 | 12/1993 | Segman | 52/292 |
| 5,268,028 | 12/1993 | Elfield | 106/726 |
| 5,272,847 | 12/1993 | Abiru et al. | 52/167 |
| 5,286,136 | 2/1994 | Mandish | 406/6 |
| 5,290,335 | 3/1994 | Stewart | 65/362 |
| 5,290,356 | 3/1994 | Frankowski | 106/726 |
| 5,292,467 | 3/1994 | Mandish | 264/112 |
| 5,299,405 | 4/1994 | Thompson | 52/795 |
| 5,303,524 | 4/1994 | Caspe | 52/167 |
| 5,303,525 | 4/1994 | Magee | 52/306 |
| 5,308,390 | 5/1994 | Kovacs | 106/677 |
| 5,308,396 | 5/1994 | Kovacs | 106/677 |
| 5,311,709 | 5/1994 | Kobori et al. | 52/167 |
| 5,313,753 | 5/1994 | Sanger | 52/251 |
| 5,314,744 | 5/1994 | Walter | 428/326 |
| 5,321,923 | 6/1994 | Knichioda | 52/167 |
| 5,324,469 | 6/1994 | Walter | 264/234 |
| 5,346,549 | 9/1994 | Johnson et al. | 106/708 |
| 5,353,569 | 10/1994 | Rodrique | 52/589 |
| 5,371,985 | 12/1994 | Suttles | 52/480 X |
| 5,433,049 | 7/1995 | Karlsson et al. | 52/294 X |
| 5,599,834 | 2/1997 | Fujimoto et al. | 52/167 |

BUILDING CONSTRUCTION METHOD

BACKGROUND OF THE INVENTION

1. Field of the Invention

This invention relates, generally, to methods and apparatus for making low cost housing. More particularly, it relates to a modular building construction that requires neither special tools nor specialized skills.

2. Description of the Prior Art

There have been numerous attempts over the years to provide inexpensive commercial structures and low cost housing. Patents that disclose apparatus and methods for providing such structures or houses often employ cementitious materials due to the relatively low cost of such materials. Typically, building blocks are precast and assembled into a structure at a construction site. The building blocks may be relatively small, such as cinderblock size, or may be as large as an entire wall or floor.

Patents disclosing construction techniques that rely upon precast building blocks of relatively large size include U.S. Pat. Nos. 3,979,863 to Hurley et. al. (contiguous wall panels are bolted to one another), 5,150,552 to Davis-Arzac (entire wall panels are either precast or poured at the site), and 4,443,985 to Moreno (the building blocks include precast concrete beams, columns, and floor slabs).

Patents that disclose small, cinderblock-size building blocks include U.S. Pat. Nos. 5,024,035 to Hanson et. al. (building blocks interconnected to one another by tongue and groove fittings so that mortar is not needed; limited to wall construction), 3,600,862 to Eckert, 4,884,382 to Horobin, and many others.

Other inventors have developed building blocks that are light-in-weight to facilitate construction and which exhibit good insulation properties. Examples of such building blocks are disclosed in U.S. Pat. Nos. 4,831,802 to Cromrich et. al. (an outer layer is formed from conventional bricking clay and a second, insulative layer is formed of clay and expanded vermiculite), 4,306,395 to Carpenter (large polystyrene beads are dispersed throughout an aqueous cementitious mixture), 3,653,170 to Sheckler (a heat-insulating organic foam is sandwiched between masonry parts of the block), and 5,290,356 to Frankowski (recycled scrap rubber crumbs are admixed with cement-like materials).

Although these earlier contributions advanced the construction art at the time of their creation, most of them require skilled laborers to complete a structure and the use of special tools. For example, the building blocks are usually bolted together or joined to one another with mortar. Perhaps even more importantly, the correct way to assemble the component parts is not readily apparent, and knowledgeable construction supervisors must therefore be present on the job site at all times, just as in conventional housing construction. Moreover, some of the designs do not teach the workers how to include windows and doors; accordingly, the workers must summon experienced door and window installers whenever a window or door installation is needed.

Moreover, little or no consideration has been given to building materials made from miscellaneous waste materials including uninsulated aggregates.

In view of the prior art as a whole at the time the present invention was made, it was not obvious to those of ordinary skill in the construction industry how the art could be further advanced.

SUMMARY OF THE INVENTION

The longstanding but heretofore unfulfilled need for an inexpensive method of erecting a structure in the absence of special tools and skilled labor has now been met.

The present invention provides a cementitious composition having from about 7 to about 65 percent by weight of a cement material, the cement material is selected from the group of cement materials including Portland cement, masonry cement, alumina cement, magnesium cement, calcium hemihydrate, insoluble anhydrite, and mixtures thereof; from about 2 to about 80 percent by weight of a filler, the filler is selected from the group of fillers including recycled polystyrene, new polystyrene, vermiculite, chopped up wood, recycled wood, plant fiber, recycled paper waste, concrete pieces, glass, rubber, recycled fiberglass, microsilica, acrylic polymers, coal ash, fly ash, stack scrubber solids, papermill waste, papermill sledge, iron, carbon steel, copper, brass, aluminum, aluminum aggregate, lead aluminum oxide, emery, fused alumina, trap rock and mixtures thereof; and from about 10 to about 35 percent by weight water, to provide a cementitious composition having a force absorbency capacity of from about 75 PSI to about 2000 PSI. In a preferred embodiment of the present invention, the cementitious composition has from about 7 to about 65 percent by weight Portland cement; from about 1 to about 20 percent by weight vermiculite; from about 1 to about 20 percent by weight polystyrene; and from about 15 to about 35 percent by weight water, to provide a cementitious composition having a force absorbency capacity of 100 to about 2000 PSI. While in a more preferred embodiment, a cementitious composition having from about 7 to about 65 percent by weight Portland cement; from about 1 to about 20 percent by weight vermiculite; from about 1 to about 20 percent by weight polystyrene; and from about 15 to about 35 percent by weight water, to provide a cementitious composition having a force absorbency capacity of 100 PSI is disclosed. Another embodiment of the cementitious composition includes from about 7 to about 65 percent by weight Portland cement; from about 20 to about 80 percent by weight mining ore waste; from about 20 to about 80 percent by weight glass; from about 20 to about 80 percent by weight sand; and from about 10 to about 35 percent by weight water, to provide a cementitious composition having a force absorbency capacity of 500 to about 5000 PSI. Finally, in another preferred embodiment of the present invention, a cementitious composition having from about 10 to about 65 percent by weight Portland cement; from about 2 to about 60 percent by weight polystyrene; from about 15 to about 50 percent by weight sand; and from about 15 to about 35 percent by weight water, to provide a cementitious composition having a force absorbency capacity of greater than 900 PSI is disclosed.

The present invention provides a structure made of building blocks having a brick-like, stone-like, masonry-like, wood-like, or other conventional-in-appearance facade backed by a thick layer of insulating material. The insulating material is an admixture of a cementitious material that includes one or more additional components capable of forming a durable cementitious aggregate such as recycled or new polystyrene, vermiculite, and fibrous organic aggregates capable of retaining water such as chopped up, recycled wood and plant fibers, recycled paper waste, and the like.

Alternatively, the backing for the facade need not be formed of insulating material; it may be made from waste materials such as post-earthquake debris, including pieces of concrete, glass, rubber, polystyrene, and the like. A cementitious mixture of vermiculite and polystyrene may also be used. Such mixture exhibits good shock-absorbing qualities and therefore is suitable for use in earthquake-resistant structures; it also floats and as such could have utility in a flood. Commercially available asphalt impregnated vermiculite, when mixed with polystyrene, provides a waterproof concrete with good fire resistance and insulating properties.

Another material suitable use in a noninsulating cementitious aggregate is waste ore of the type typically deposited in mining areas. In South Africa, for example, mountains of waste ore are available for processing into the wall blocks, corner blocks, and floor tiles of this invention. Of course, ordinary concrete may also be used. However, this invention contemplates that people needing housing in remote areas will use locally available waste materials to become a part of the cementitious mixture used to form the building blocks of this invention.

The building blocks are made in a mold; materials for forming the facade are first introduced into the mold, followed by, a cementitious mixture comprising chopped up wood, recycled wood and paper fibers, or wood fibers only, or other fibrous organic aggregates, and virgin or recycled polystyrene, vermiculite, debris, and the like. About the only material not suitable for use as a part of the novel cementitious aggregate is food particles.

Each block has a top and bottom surface, a pair of end surfaces, an exterior surface and an interior surface. The top and bottom surfaces of each block are preferably formed into an undulating, sinusoidal shape so that the blocks interlock with one another when stacked vertically; significantly, the undulations extend from the exterior surface to the interior surface; this allows slippage between contiguous blocks in a longitudinal direction but not in a transverse or lateral direction. This enhances the chances for survival of the structure when it is subjected to earthquakes.

Other mating shapes that provide an interlocking means are within the scope of this invention, as more fully set forth hereinafter.

Each block has a central opening formed therein so that a vertically extending bore is formed when said blocks are stacked; in a first embodiment (where the walls of the structure support the weight of the roof), an elongate reinforcing rod is inserted through said central bore to oppose bending or tensile forces applied to the stacked blocks. More particularly, a hook is formed in the foundation of the building at intervals along the extent thereof to coincide with the central bores when the walls are erected. Thus, a reinforcing rod is lowered through each central bore after the walls have been erected and its lowermost end is engaged to a hook; the uppermost end of the rod is externally screw threaded so that the rod is tightened by rotating an internally threaded handle that engages said uppermost end. Concrete is poured into the openings, thereby embedding said reinforcing rods, to complete the walls.

Each block further includes a recess formed in its opposite ends, and each recess has a breadth about half that of the central bore so that confronting recesses of contiguous blocks collectively form a concrete-receiving bore having the same breadth as the central bore. Reinforcing rods may also be introduced through these end bores to engage hooks that extend from the foundation.

A first, vertically extending recess may also be formed in the interior surface of each wall block so that an elongate, vertically extending recess is collectively formed in the interior surface of a wall by a plurality of said blocks disposed in vertically stacked relation to one another. Similarly, a second, horizontally extending recess may be formed in the interior surface of each wall block so that an elongate, horizontally extending recess is formed in the interior surface of a completed wall. The horizontally extending recess is in open communication with the vertically extending recess so that electrical wiring, pipes for plumbing, or the like may be inserted into said recesses and hidden from view when drywall or other suitable wall covering is attached to the interior surface of the blocks.

A door or window opening is formed by leaving a space of appropriate size and lining a bottom and opposed sides of said space with bottom and side channel members having a flat part and an integral pair of side walls normal thereto. A vertical extent of an opening for a window or a door is covered by placing the flat part of the side channel members into overlying relation to the opposed sides of the opening so that the side walls of the side channels overlie part of the exterior and interior walls of the blocks contiguous to the opening. The bottom of the opening is covered by placing the flat part of the bottom channel in overlying relation to the bottom of the opening such that the side walls of said bottom channel overlie a part of the exterior and interior surfaces of blocks contiguous thereto.

A door side channel having a projection to which vertically spaced apart hinges are preattached is vertically disposed within a door opening to facilitate hanging of a conventional door. Door top and bottom channels having such projections but lacking hinges are horizontally disposed at the top and bottom of the door opening so that the projections form stops for the door.

A window channel of similar construction includes a pair of parallel, vertically extending projections that are spaced apart from one another by a predetermined distance so that a window frame (including a window pane) may slidingly fit therebetween.

The provision of such channels for door and window construction eliminates the need for skilled window and door installers.

The foundation of the novel building is essentially conventional, with two exceptions. First, the uppermost surface thereof is corrugated or otherwise shaped to match the corrugations or other shape formed in the bottom surface of the wall blocks stacked thereatop. Secondly, slots are formed at equidistantly spaced intervals along the extent of the foundation in the interior edge of opposing parts thereof, and each of said slots is in open communication with a top surface of the foundation and has a predetermined depth that does not extend through the foundation. Horizontal floor trusses are positioned in spanning relation between opposing parts of the foundation with the opposite ends of said floor trusses being slideably received within the slots. The horizontally disposed floor trusses have a vertical extent equal to the depth of the slots so that the opposite ends of the trusses that are received within the slots are flush with the top surface of the foundation.

A key is formed, uninterrupted, along the entire upper edge of each floor truss, and said key projects slightly upwardly therefrom. Each panel of a plurality of flat floor panels has opposing edges sculpted to form a keyway to slidingly receive said key so that the panels are installed by sliding them between contiguous floor trusses. The leading and trailing ends of contiguous panels may be shiplapped or interlocked through a tongue and groove.

In the first embodiment, elongate angle members are placed in overlying relation to the exterior and interior upper edges, respectively, of the uppermost blocks that form the walls. The angle members are interconnected at equidistantly spaced apart intervals along their respective extents by flat cross members. Upstanding mounting tabs are secured to preselected cross members so that transversely spaced apart walls are surmounted by said mounting tabs. Each tab is apertured so that roof trusses, similar in construction to the floor trusses, may be bolted or otherwise secured thereto.

The roof tiles have keyways formed in their opposing edges that are slideably received onto an elongate key, but the bottom surface of the roof tile keyway is wider, i.e., has a greater breadth than the bottom surface of the floor tile keyway. This increased width allows the roof tile keyways to function as gutter feeders between contiguous rows of roof tiles. The leading and trailing ends of the roof tiles are shiplapped. Each roof tile is also shaped so that water runs towards said gutter feeders, i.e., each tile is thicker at its middle than at its edges so that water flows toward said edges and into said gutter feeders. The gutter feeders feed gutters which are also of novel construction.

The novel roof tiles may also be used in conventional construction as the original roof or as a replacement roof. A novel tile engaging strip is mounted onto conventional roof sheathing, and the novel roof tiles are then slid into position in the manner disclosed in detail hereinafter. The novel roof panels are fireproof and will last indefinitely; they may also include insulating materials as mentioned earlier. As an additional benefit, installation of the novel roof tiles requires neither special skills nor special tools.

In a second embodiment, the walls do not support the weight of the roof. Instead, the weight of the roof is distributed along horizontal concrete beams that surmount the walls, and said beams transfer the weight to vertical column blocks which in turn transfer the weight to foundation beams and footings. The anti-bending means in this embodiment is an assembly of rods linked together in a square pattern by a plurality of longitudinally spaced apart bands. The lowermost end of each rod assembly is secured to a flat plate that is positioned atop the foundation of the structure; said flat plate need not be attached to said foundation. Specifically, each lowermost end is secured to a rebar that protrudes through the foundation and the flat plate. As more fully set forth below, a similar assembly of rods is positioned horizontally in surmounting relation to the walls of the structure and used as a part of the roof construction.

The second embodiment also includes means for accommodating heating and air conditioning ductwork. In such second embodiment, the wall-surmounting angle members of the first embodiment are not used. Instead, an elongate, flat concrete beam is positioned in surmounting relation to the exterior edges of the walls along the extent thereof to form an outer wall for the ductwork. An elongate concrete beam having an "L" configuration is positioned in surmounting relation to said blocks in slightly set back relation to the interior edges thereof so that the truncate part of the "L" is flush with a horizontal plane within which lies the interior surfaces of the wall blocks. Thus, when drywall or other wall covering is attached by suitable means in overlying relation to the interior surfaces of the wall blocks, said wall covering encloses a space between said wall covering and the elongate part of the "L" shaped slab; the space so defined forms a duct.

The beams support the weight of the roof. Therefore, the wall blocks of this embodiment may have less compressive strength than the weight-supporting wall blocks of the first embodiment. Thus, almost any aggregate, excepting food particles as aforesaid, may be used to make the wall blocks used in this second embodiment.

The space between the exterior beam and the interior, "L"-shaped beam is occupied by the aforementioned banded-together assembly of anti-bending rods positioned in horizontal disposition therewithin. An apertured truss-engaging tab is mounted to each of said bands, and roof trusses are secured to said tabs as in the first embodiment.

Thus it is understood that the primary object of this invention is to advance the construction arts by providing novel parts and novel assembly methods for enabling construction of a building at very low cost and in the absence of skilled workers and special tools.

Another important object is to provide a building block having a novel composition, a low weight, good insulative properties, and other desirable features.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
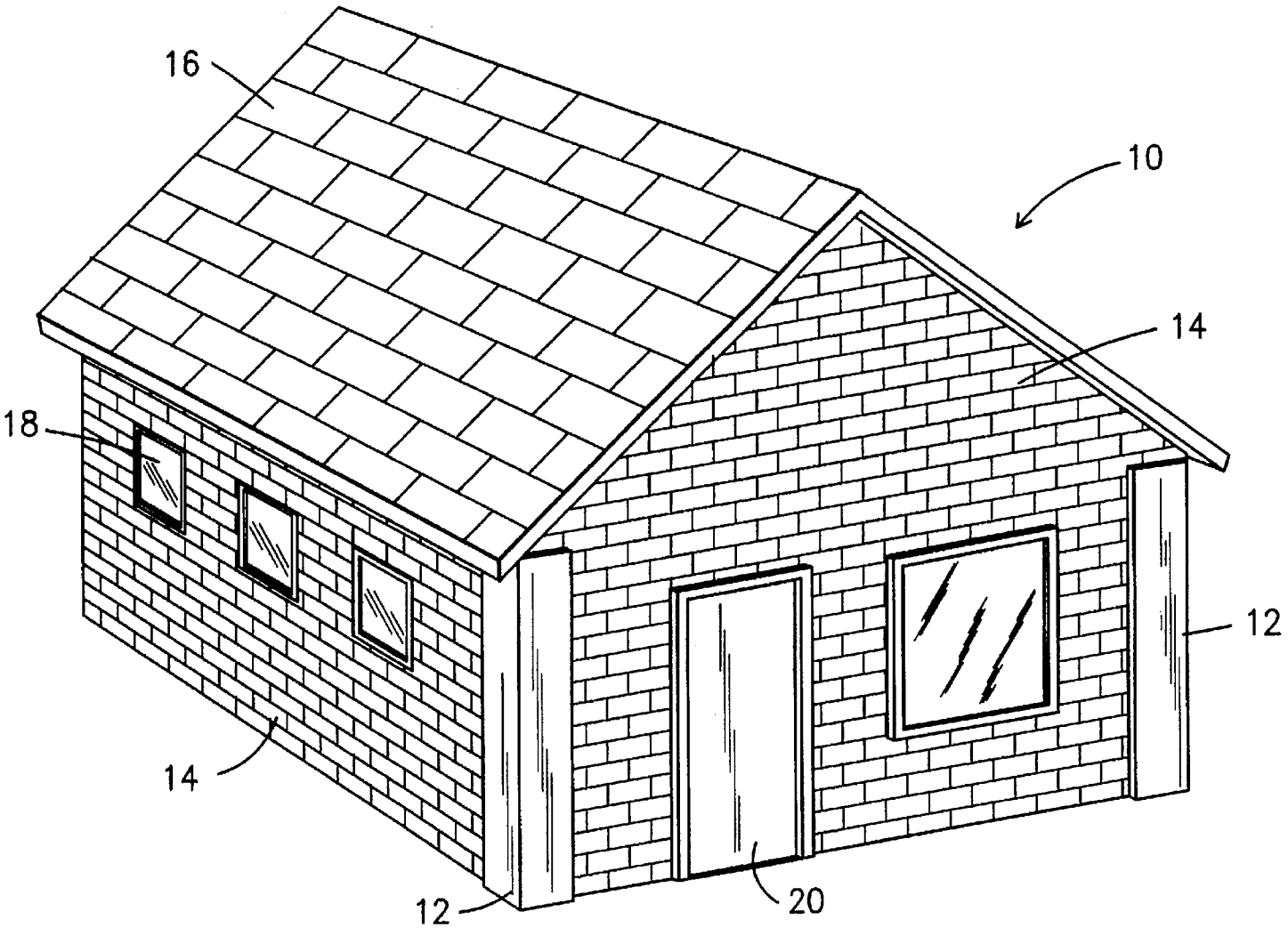
FIG. 1 is a perspective view of an exemplary structure made in accordance with the novel method.

The present invention, as previously stated, relates to methods and apparatus for making low cost housing which includes modular building construction that requires neither special tools nor specialized skills. The present invention is also directed to cementitious compositions which are useful in the method of the present invention. The cementitious composition of the present invention comprises cement-like material, water, and one or more readily available filler materials, as set forth in greater detail below. The amount of each of the constituents employed in the cementitious compositions can vary widely and will be dependent, to a large degree, upon the density and weight characteristics sought in the cementitious product produced, as well as the use for which the product is employed. In addition, the final composition will be dependent to a large extent upon the availability of low cost filler materials which impart the desired density, weight and useful properties and characteristics, such as absorbency and durability, sought in the final cementitious composition. The cementitious compositions of the present invention are made by standard methods known to those skilled in the art of the construction and cement trade.

Those skilled in the art of the construction and cement trade know that prior to the present invention it was believed that cementitious compositions which were used as blocks and other structural components in the building industry required extremely high force absorbency capablities. For example, cementitious compositions which withstand only approximately one hundred (100) to approximately five hundred (500) pounds of force per square inch (PSI) of cementitious material were thought to be sturcturally inadequate for use in the trade. Surprisingly, due to the unique characteristics of the cementitious compositions of the present invention, blocks and other structural components having force absorbency capabilities of only about one hundred (100) to about four hundred (400) pounds per square inch (PSI) are extremely useful. In particular, certain cementitious compositions of the present invention which absorb only 100 PSI are formulated to float and upon exceeding 100 PSI disintegrate by turning to dust. These characteristics are advantageous because not only are the cementitious compositions cost effective to produce but they can also be used in flood and earthquake zones. The floatability of the cementitious compositions of the present invention allows post-flood recovery of reuseable construction components. Further, the disintegration characteristics of the present cementitious compositions decreases the injuries concomitant with the destruction of structural building components during earthquakes.

Additional components, known to those skilled in the art, may be added to the cementitious material of the present invention, such as, binders and plasticizers. Binders include calcium aluminate cement, magnesium phosphate cement, other inorganic cements and polymer cements. Plasticizers include sulfonated melamine formaldehyde and sulfonated naphthalene formaldehyde. It is undesirable to add additional components since some of these components are prohibitively costly, while others are known carcinogens. However, the use of additional components are not required in the compositions of the present invention. It is a further unexpected advantage of the present invention that the cementitious compositions possess the above-mentioned desirable characteristics in the absence of additional components thereby reducing the cost and health hazards associated with the production of the presently claimed cementitious compounds.

For purposes of the present invention, readily available filler materials may possess insulating properties including, but are not limited to, recycled or new polystyrene, vermiculite, fibrous organic aggregates capable of retaining water such as chopped up wood, recycled wood, plant fiber, recycled paper waste, and the like. Alternatively, it is not necessary that the readily available filler materials possess insulating materials. For example, the readily available filler materials may impart other desirable characteristics to the cementitious composition. As previously stated, the readily available filler materials may impart other desirable characteristics such as buoyancy, absorbency or pulverulent characteristics. These characteristics are particularly important in developing nations which lack the natural resources and/or economic power to produce and/or purchase traditionally more expensive conventional building materials. Other readily available filler materials include waste materials such as post-earthquake debris including pieces of concrete, glass, rubber, and polystyrene, recycled fiberglass, microsilica, acrylic polymers, coal ash, fly ash, stack scrubber solids, papermill waste, including papermill sledge, metal fibers including iron, carbon steel, copper, brass, aluminum, aluminum aggregate, lead aluminum oxide, emery, fused alumina, trap rock and the like.

As used in the present disclosure the terms "cement" or "cement-like" material is to be understood to include any aqueous based material which is initially a slurry and upon curing produces a solid, substantially homogenous material. Cement includes hydraulic cements, such as Portland cement, masonry cement, alumina cement, magnesium cement and the like; and gypsum, such as calcium hemihydrate, insoluble anhydrite, and the like.

The term "masonry cement" as used herein is to be understood to mean a special group of cements for the use in mortars for masonry construction. Such masonry cements are more workable and more plastic than Portland cement. Masonry cement may be similar to waterproofed Portland cement while other types of masonry cement include Portland cement mixed with hydrated lime, crushed limestone, diatomaceous earth or granulated slag. Further, as used herein and as accepted in the construction and cement trade, the term masonry cement represents a separate and distinct class of cements from the term Portland cement as used herein.

EXAMPLES

The following Examples serve to provide further appreciation of the invention but are not meant in any way to restrict the effective scope of the invention.

Example 1

A cementitious composition was formed using the following components in the designated percentages by weight:

| Component | Weight Percent |
|---|---|
| Cement | 7–65 |
| Polystyrene | 1–20 |
| Vermiculite | 1–20 |
| Water | 15–35 |

Example II

A cementitious composition was formed using the following components in the designated percentages by weight:

| Component | Weight Percent |
|---|---|
| Cement | 7–65 |
| Polystrene | 1–20 |
| Vermiculite | 1–20 |
| Water | 15–35 |

The cementitious composition listed above is useful in the production of structural components for the construction of affordable housing in flood and earthquake zones. The composition floats, in addition, it disentigrates to a dust when a force exceeding 100 PSI is exerted upon it.

Example III

A cementitious composition was formed using the following components in the designated percentages by weight:

| Component | Weight Percent |
|---|---|
| Cement | 7–65 |
| Mining Ore Waste | 20–80 |
| Glass | 20–80 |
| Sand | 20–80 |
| Water | 10–35 |

The cementitious composition listed above is useful in the production of structural components including wall blocks, roof tiles and corner blocks.

Example IV

A cementitious composition was formed using the following components in the designated percentages by weight:

| Component | Weight Percent |
|---|---|
| Cement | 10–65 |
| Sand | 2–60 |
| Polystyrene | 15–50 |
| Water | 15–35 |

The cementitious composition listed above is useful in the production of floor tiles. The composition withstands greater than 900 PSI of force.

While there have been described what are presently believed to be the preferred embodiments of the invention, those skilled in the art will realize that changes and modifications may be made thereto without departing from the spirit of the invention, and it is intended to claim all such changes and modifications as fall within the true scope of the invention.

Referring now to FIG. 1, it will there be seen that an illustrative embodiment of the invention is denoted as a whole by the reference numeral 10.

A simple rectangular version of house 10 is depicted, although it should be understood that the construction methods of this invention can produce a house or other building of any desired shape. Moreover, the number, size, and positioning of doors and windows is equally flexible.

House 10 is built on a concrete foundation and all of its parts are made of concrete or aggregates such as concrete, mulch, polystyrene, glass, rubber, general debris and the like as aforesaid.

House 10 includes corner supports 12, walls 14, roof 16, windows 18, and a door 20.

Figure 2:
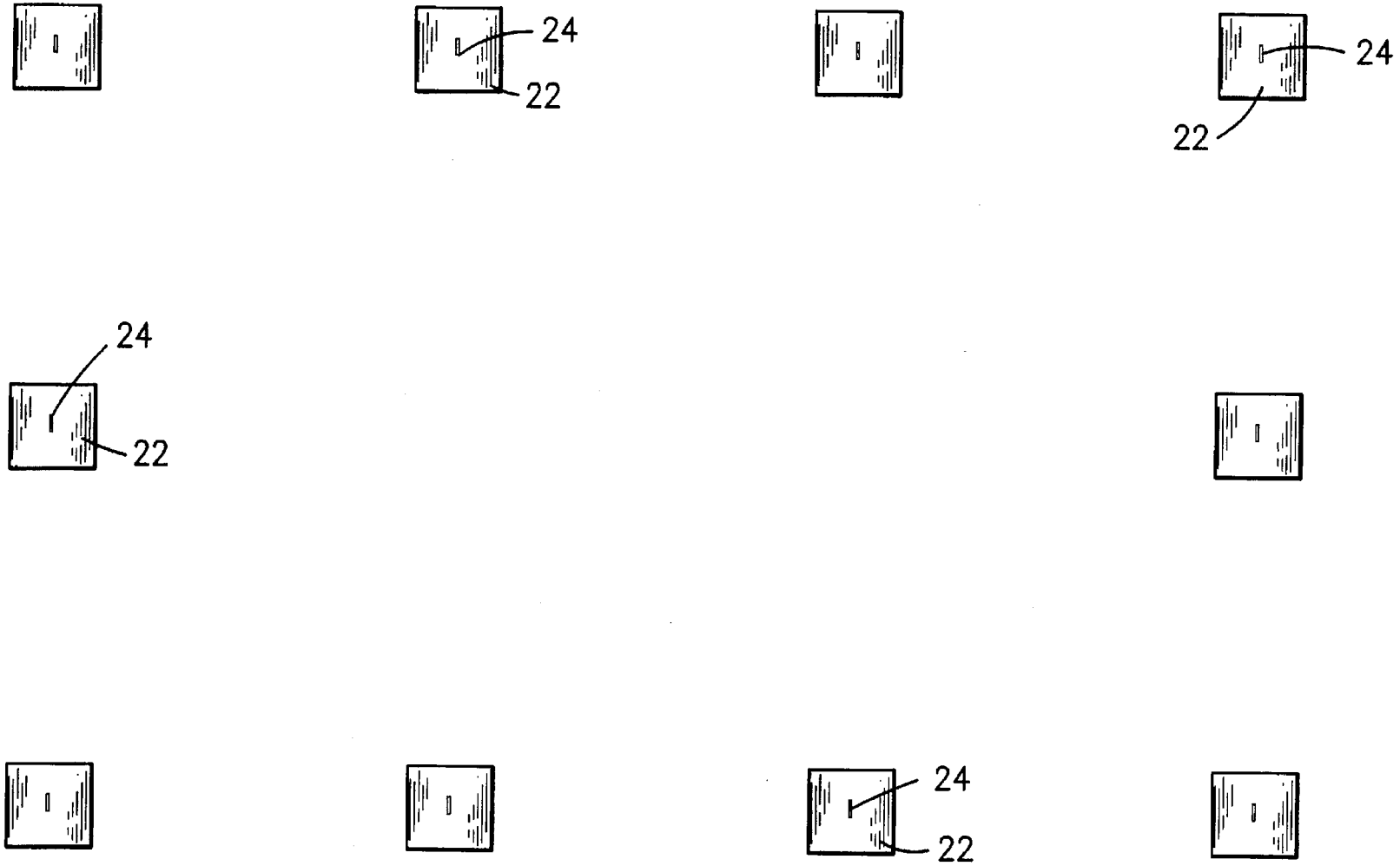
FIG. 2 is a plan view of the foundation blocks of the structure depicted in FIG. 1.

Construction of a house having a simple shape such as house 10 begins with the positioning of concrete blocks 22 in the pattern disclosed in FIG. 2 on a suitable ground surface; different patterns are used for houses of differing shapes. Alternatively, holes are dug and concrete or other suitable cementitious product is poured into the holes to create the same structure, but with the advantage of making the top surface of each block 22 flush with the ground.

Figure 3:
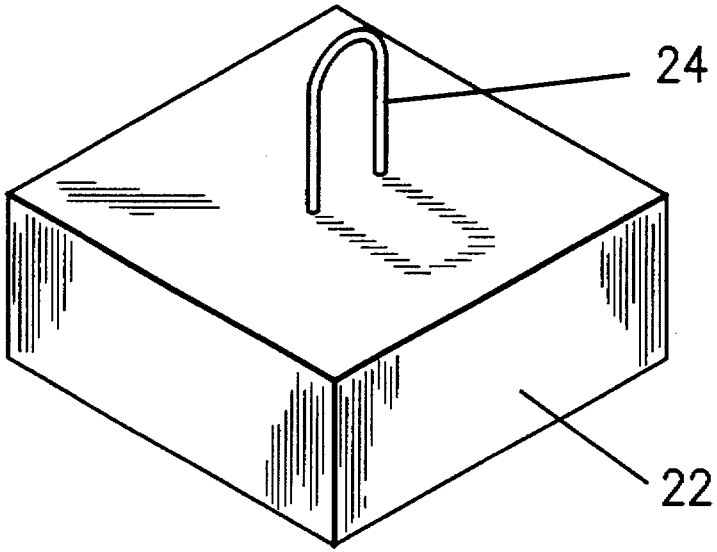
FIG. 3 is a perspective view of one of the foundation blocks depicted in FIG. 1.

A block 22 is disclosed in greater detail in FIG. 3. A metal hook 24 having the appearance of an inverted "U" has its transversely spaced apart opposite ends embedded within the concrete so that hook 24 cannot be separated from the concrete after said concrete has cured. These hooks are used at a later step in the novel method.

Figure 4:
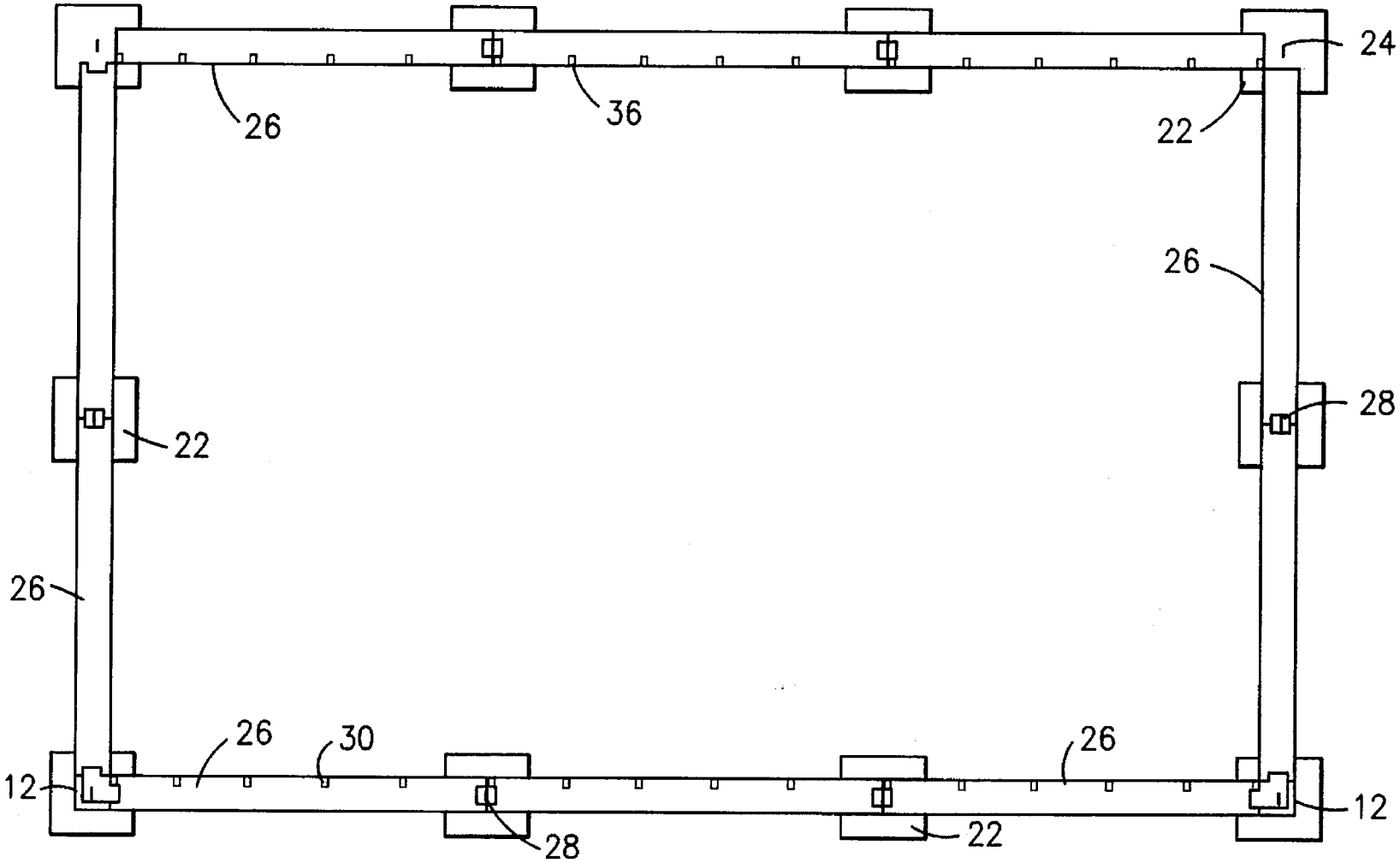
FIG. 4 is a plan view depicting foundation beams supported by the foundation blocks of FIG. 2.

A plurality of elongate foundation beams, collectively denoted 26, are then placed in bridging relation between contiguous pairs of foundation blocks 22 as depicted in FIG. 4. Note that a notch or recess 28 is formed in the opposite ends of each foundation beam 26 to enable access to each hook 24 from above. Corner supports 12 are also installed at the corners of the structure at this step of the method.

Note further that a notch or recess 30 is formed along the inner top surface of each longitudinally disposed foundation beam 26 at equidistantly spaced intervals along the longitudinal extent thereof.

Figure 5:
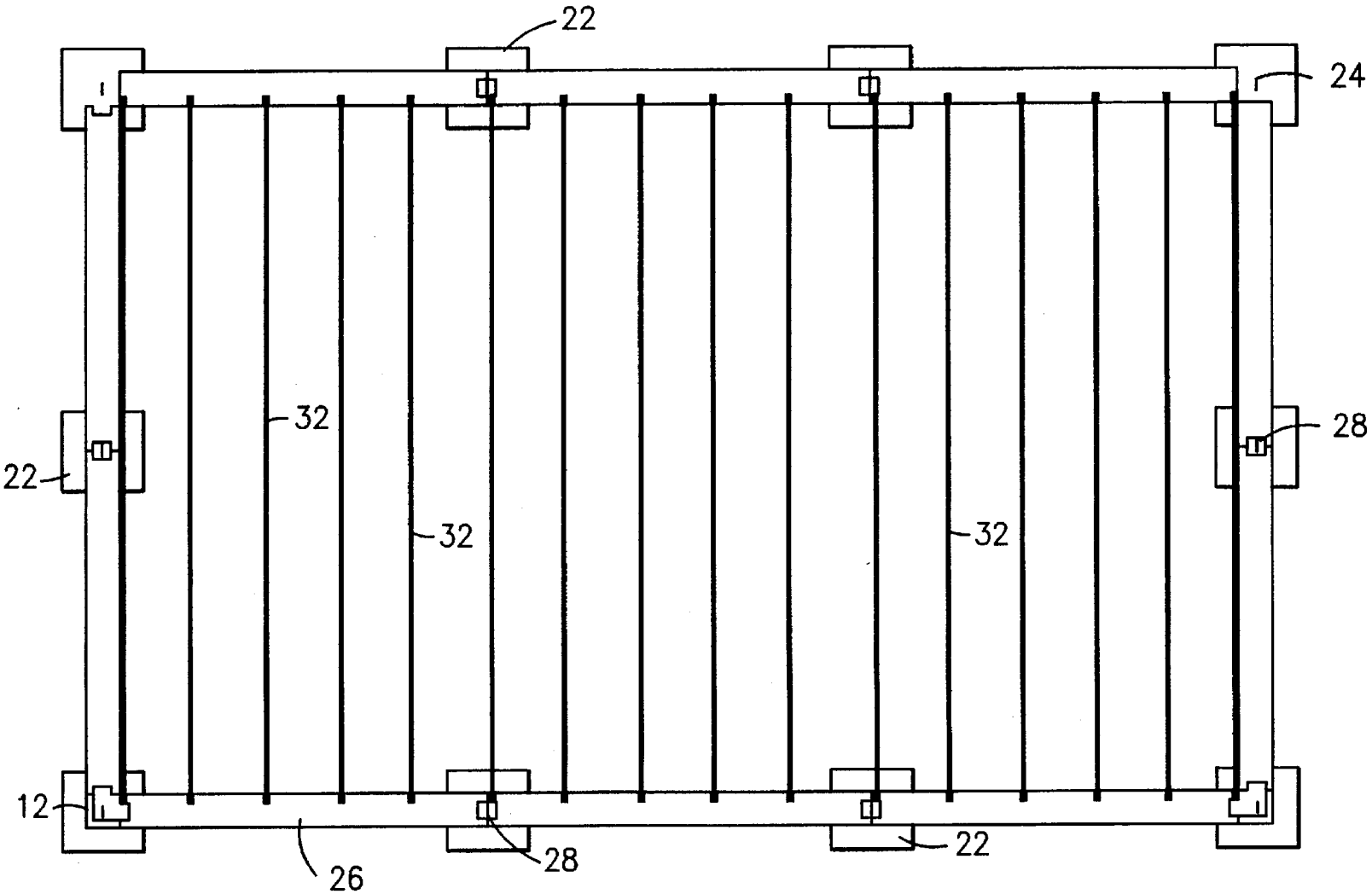
FIG. 5 is a plan view depicting floor trusses supported by the foundation beams of FIG. 4.

The opposite ends of a plurality of transversely disposed floor trusses, collectively denoted 32 in FIG. 5, are then inserted in notches 30.

Figure 6:
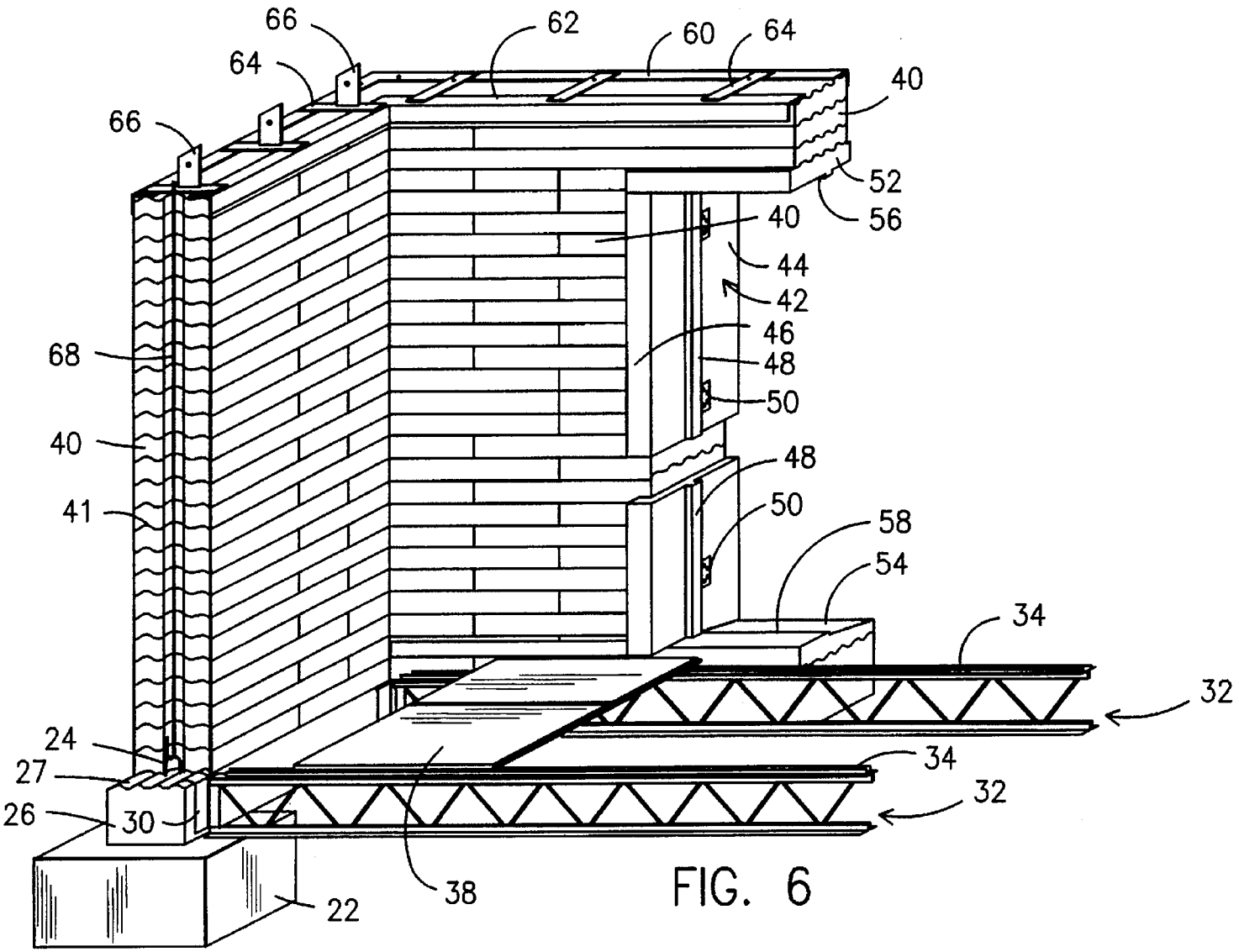
FIG. 6 is a perspective view of the structure depicted in FIG. 1 at various stages of the construction process.

The preferred structure of each floor truss 32 is depicted in FIG. 6. The opposite ends of said trusses 32 fit within notches 30 formed in the inner top surface of the foundation beams 26 as aforesaid, and the unnotched part of the top surface of each foundation beam 26 has an undulating configuration as at 27.

The top surface and underside of each block 40 has an undulation 41 formed therein to match undulation 27 formed in the top surface of the foundation beams 26 and to match the undulation formed in the other blocks. This mortarless interlocking of blocks helps prevent sliding of the blocks with respect to said foundation beams and with respect to one another in a direction transverse to the axis of symmetry of the undulations.

Figure 6B:
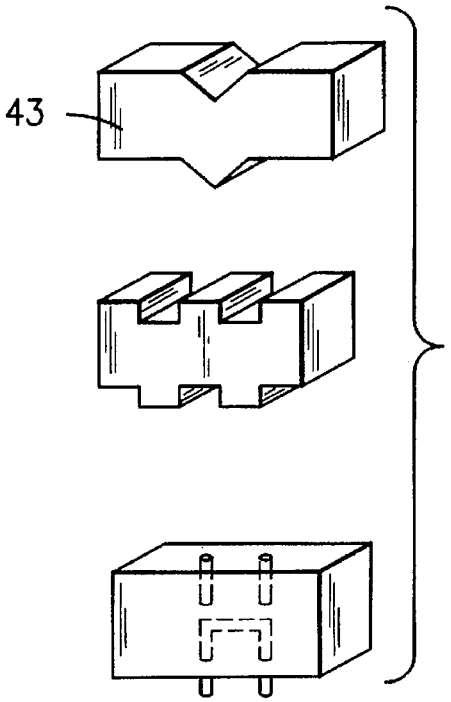
FIG. 6A is a perspective view providing an animation of an alternative method for installing tensioning rods used in the FIG. 6 embodiment.

FIG. 6B depicts a plurality of additional exemplary matching surfaces, collectively denoted 43, that could be employed in lieu of undulating surfaces 41. All interlocking means that employ interlocking mating surfaces are within the scope of this invention.

Returning now to FIG. 6, a channel-shaped door frame 42 has a flat wall 44 that overlies the end of a block 40 and has a pair of opposed sidewalls 46 that overlie outer and interior surfaces of said blocks adjacent said end as depicted. A door jamb 48 is built into each flat wall 44 and hinges 50 are secured to said jamb as depicted. The top and bottom of each door frame is completed with top and bottom members 52 and 54, respectively, that include door stops 56, 58. Thus, unskilled labor may be employed to install doors; all that is needed is to leave the door openings as above-mentioned when blocks 40 are first stacked, and to assemble opposing side channels 42 and top and bottom members 52, 54 in the positions disclosed in FIG. 6. It is then a simple matter to use a screwdriver to attach a door to hinges 50.

Windows 18 are installed in substantially the same way. However, instead of having a single projection like door jamb 48 built therein, each of the opposed side channels that form a part of the window assembly has two such projections 49, 51 disposed in parallel, spaced apart relation to one another, as perhaps best understood in connection with FIG. 9. A complete window frame assembly is slidingly introduced between projections 49, 51 before top channel member 52 is installed in bridging relation to the side channels.

Roof construction begins after walls 14 have been built to their desired height. As best understood in connection with FIG. 6, elongate angle members 60 and 62 are placed in overlying relation to the exterior and interior upper edges, respectively, of the uppermost wall blocks 40; note that said angle members are interconnected at equidistantly spaced apart intervals along their respective extents by flat cross members collectively denoted 64. Upstanding mounting tabs, collectively denoted 66, are secured to preselected cross members 64 so that transversely spaced apart walls are surmounted by said mounting tabs. Each tab 66 is apertured as shown so that roof trusses may be bolted or otherwise secured thereto.

The next step in the novel construction process is the step of reinforcing walls 14 with reinforcement bars. In this first embodiment of the invention, this is accomplished by engaging each embedded hook 24 with a hook-shaped lower end of an elongate tension rod 68 having its upper end secured by a cross member 64. More particularly, as depicted in FIG. 6, each cross member 64 is apertured to receive the externally threaded uppermost end of each tension rod 68. Thus, tightening a nut (not shown) secures rod 68 into position. Rods 68 are embedded in concrete when concrete is poured into the openings in the wall blocks.

Figure 6A:
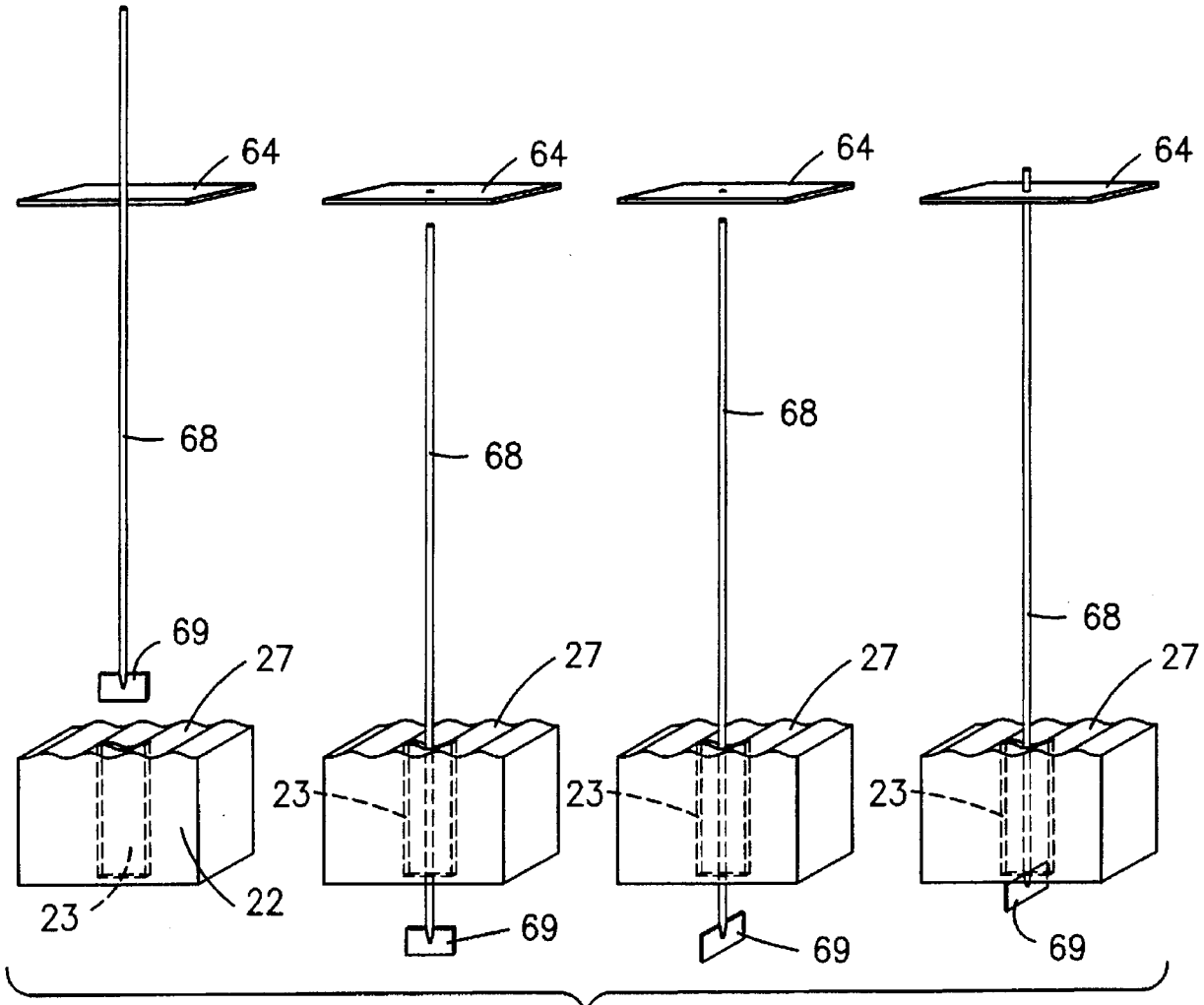

An alternate means for attaching the lowermost end of a tension rod 68 to foundation block 22 is depicted in animation in FIG. 6A. A flat bore 23 is formed in block 22 and a flat plate 69 is secured to the lowermost end of a tensioning rod 68. As indicated in the animation, flat plate 69 is rotated ninety degrees after passing completely through bore 23 so that it cannot reenter said bore. Tightening rod 68 at its upper end as aforesaid thus results in tensioning of said rod. This provides resistance to bending or tensile forces applied against walls 14 and is needed because concrete exhibits poor tensile strength as is well known.

Figure 7:
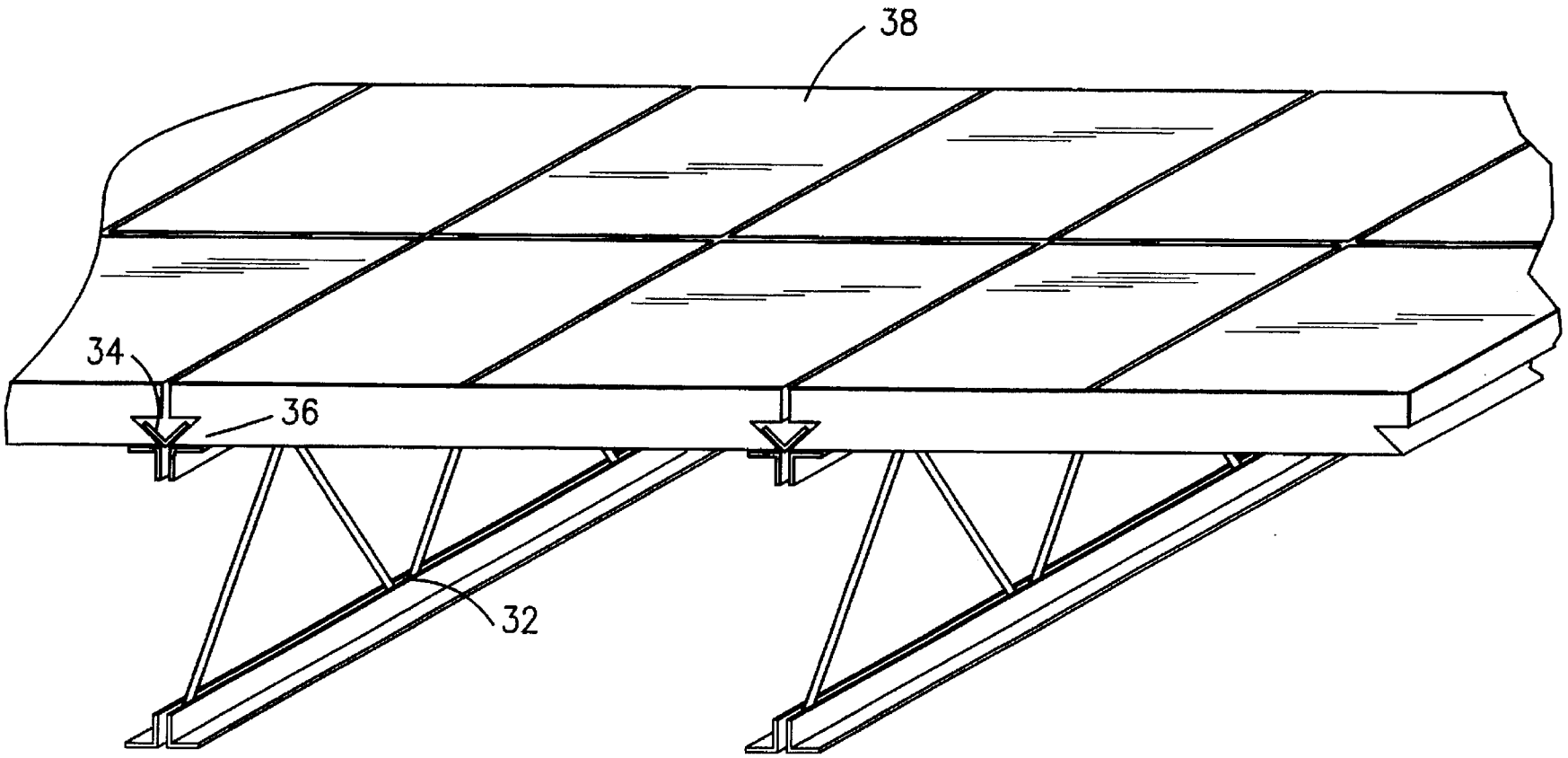
FIG. 7 is a perspective view depicting floor panels engaged to the floor trusses of FIG. 5.
Figure 8:
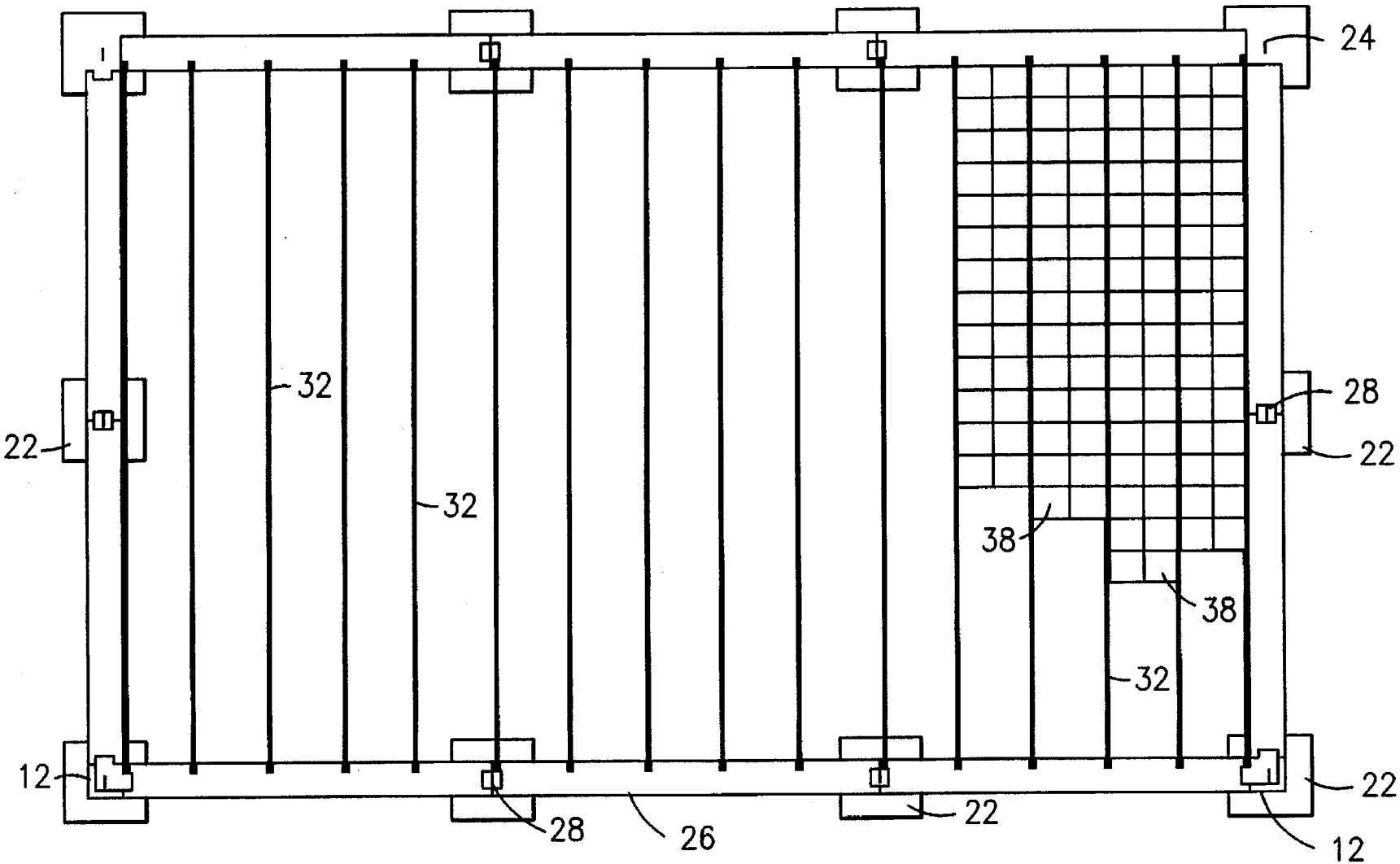
FIG. 8 is a plan view depicting floor panels supported by the floor trusses of FIG 5.

As best understood in connection with FIG. 7, an elongate "V"-shaped rail or key 34 surmounts, uninterrupted, each floor truss 32 and is integrally formed therewith or suitably secured thereto. A complementally formed elongate notch 36 that is formed in opposite edges of a floor panel 38 slideably engages said rail 34 when the floor of the house is installed. More particularly, as should be understood from FIGS. 7 and 8, the notches 36 on opposite ends of each floor panel 38 are slid into position so that each floor panel bridges a pair of contiguous floor trusses 32. Thus, unskilled workers can slide the floor panels 38 into position until the entire floor has been built as depicted in FIG. 9.

Figure 9:
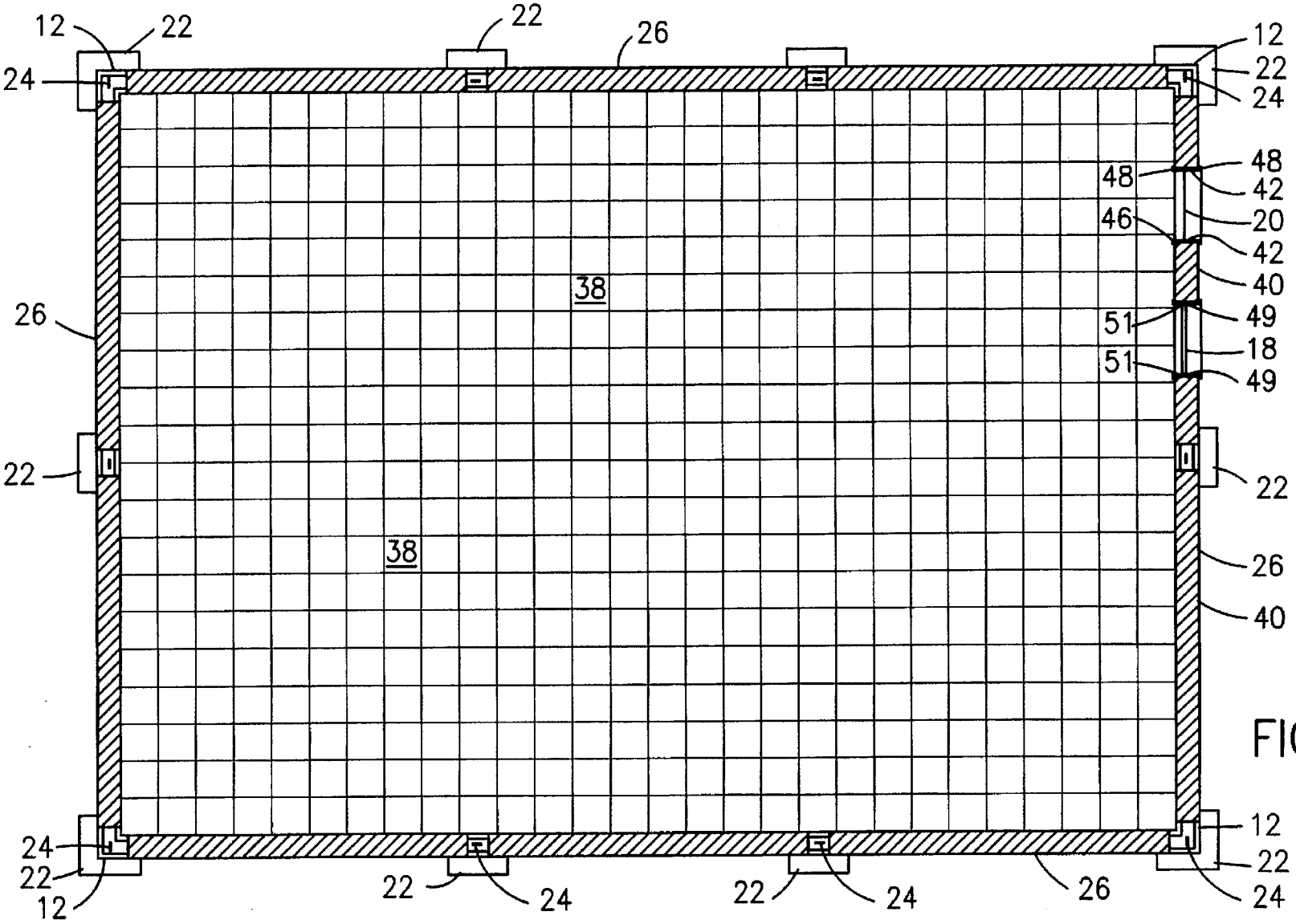
FIG. 9 is a plan view of a structure like that of FIG. 1 depicting at least some building blocks stacked atop the foundation beams of FIG. 4 to form a wall, disclosing how openings are left for windows and doors, and depicting the floor of such structure after all floor panels have been installed.

FIG. 9 also depicts the initial steps in building the walls, windows, and doors of the structure. A lowermost layer of blocks 40 is positioned in overlying relation to the foundation beams 26, leaving openings for doors 18 as desired. Additional layers of said blocks are then stacked in overlapping relation to one another as best understood in connection with FIG. 6 to build walls 14, leaving openings for windows 18 in the positions specified in the building plans. Note further in FIG. 9 that an opening is formed in the center of each block 24; this opening provides access to the aforementioned hook 24 embedded in each foundation block 22, as indicated in the lower right hand corner of FIG. 9.

Figure 10:
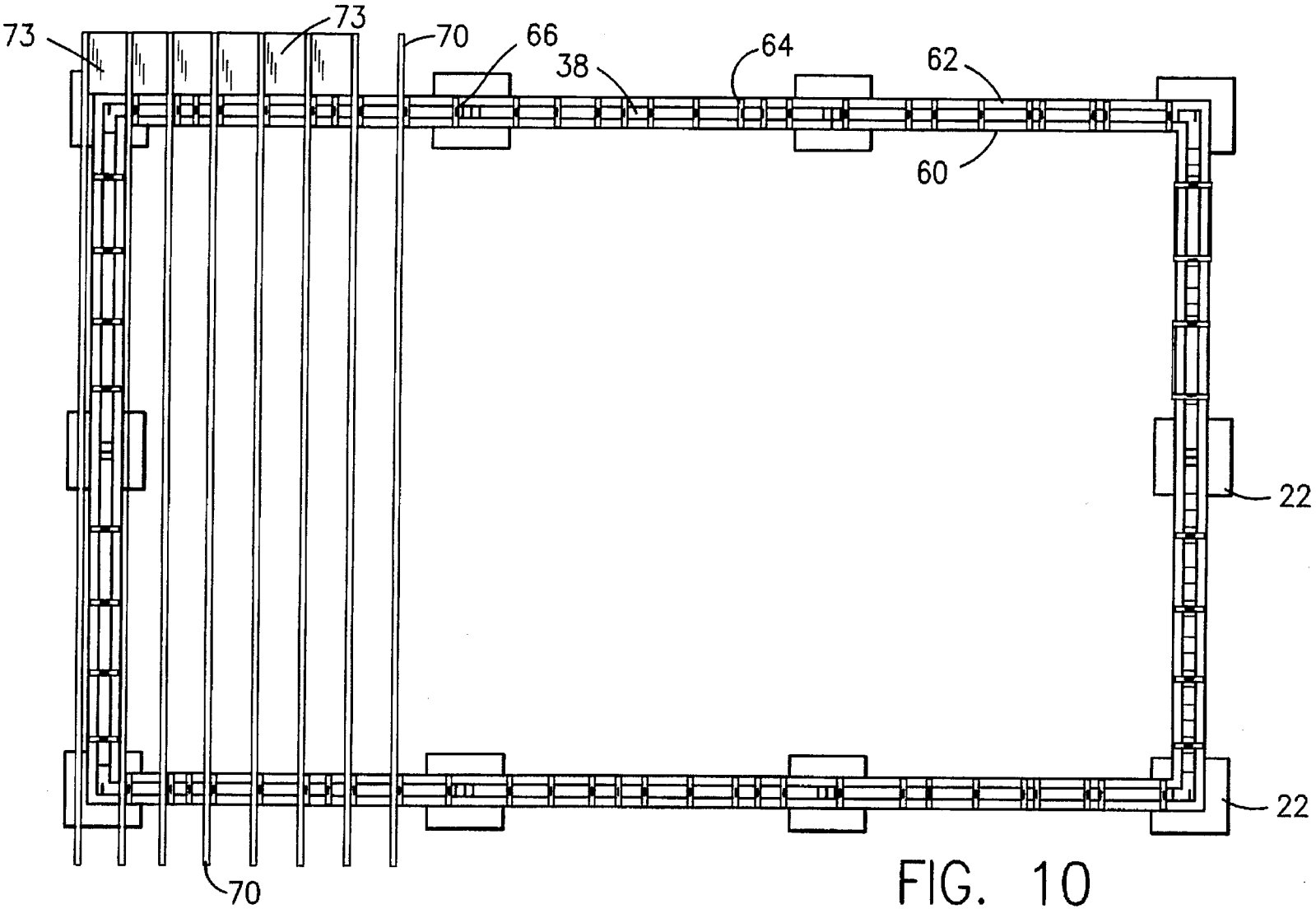
FIG. 10 is a plan view depicting roof trusses supported by the walls of FIG. 9 and associated parts to which said roof trusses are secured.

The angle members 60, 62 that surmount the walls in this first embodiment and the cross members 64 that interconnect said angle members to one another are depicted in plan view in FIG. 10. That Fig. also discloses that the next step in the novel construction procedure after installation of the angle member assembly is the connection of roof trusses, collectively denoted 70, to upstanding tabs 66 which are mounted on said cross members as aforesaid.

Figure 11:
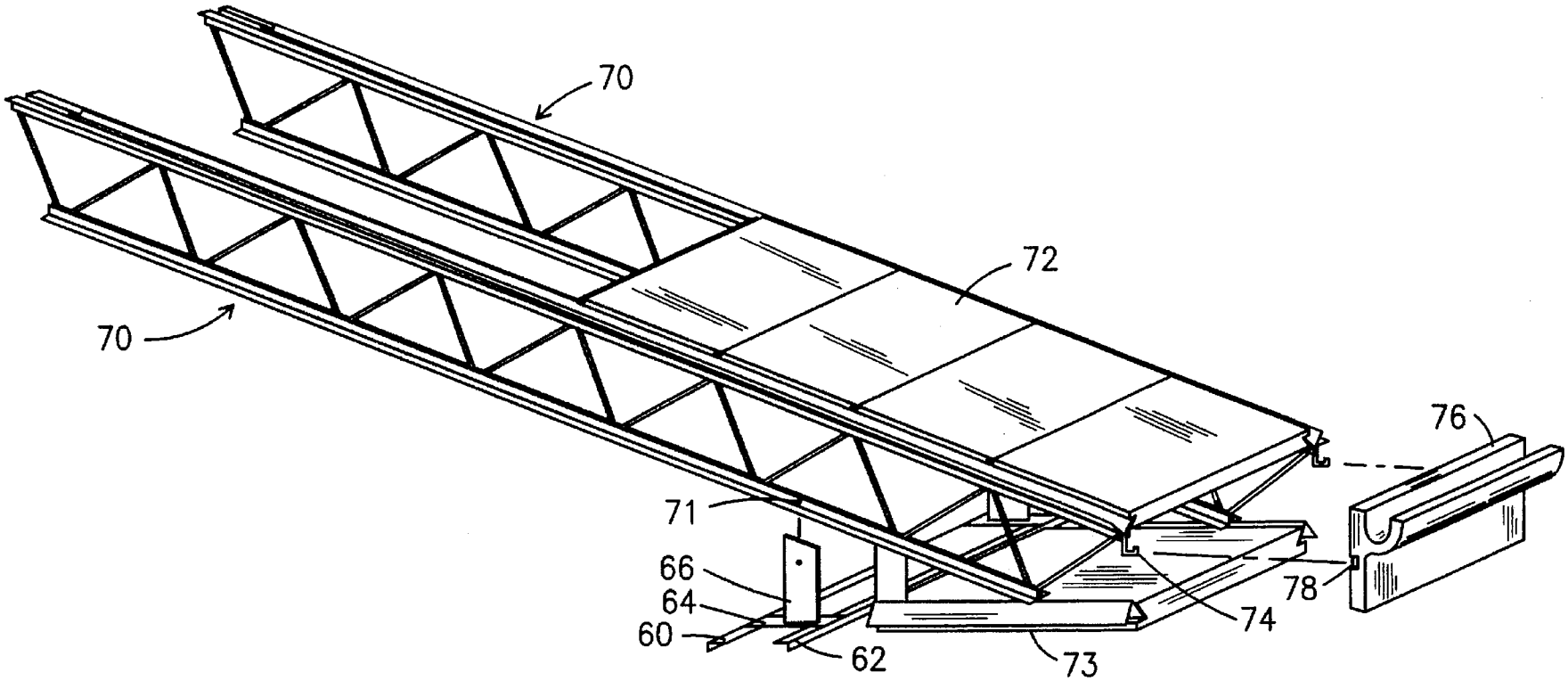
FIG. 11 is a perspective view of the novel roof construction.

As disclosed in FIG. 11, roof trusses 70 have substantially the same configuration as floor trusses 32. The lowermost rail of each truss 70 has a bolt-receiving aperture 71 formed therein, however, to enable attachment thereof to its associated upstanding tab 66. Modular roof panels, collectively denoted 72, are then slid into position just as in the floor construction step of the method. Note how each roof panel 72 is stepped in its leading and trailing edges to provide a shiplap engagement with its contiguous panels. Caulking is preferably added to each joint to seal against moisture penetration.

FIG. 11 also depicts how a soffit is provided. A soffit panel 73 having substantially the same configuration as a roof panel 72 is inverted as shown and slidingly engaged to the lowermost edge of its associated roof truss 70. FIG. 10 provides a plan view of a few of the soffit panels 73 in their installed position.

Figure 12:
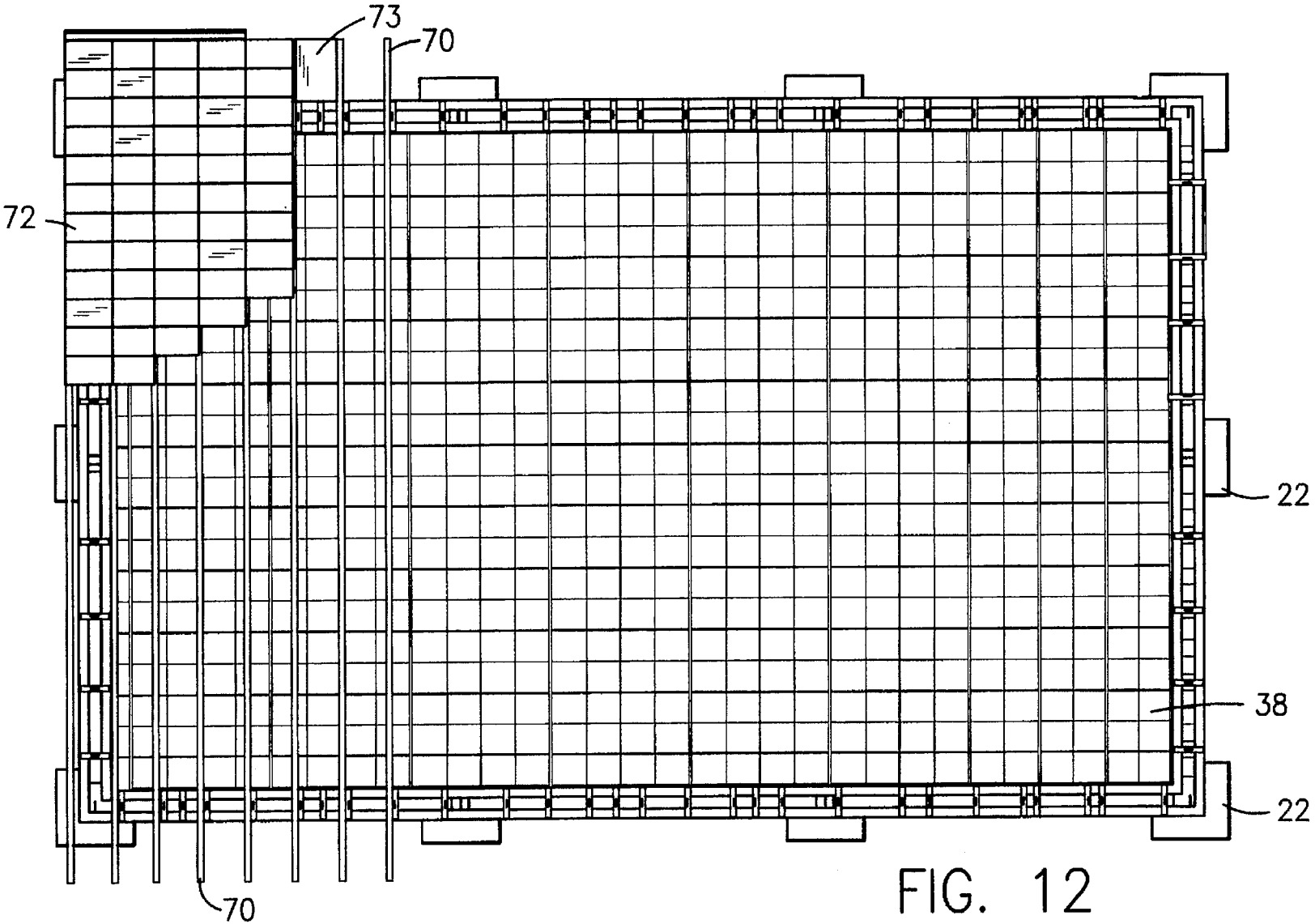
FIG. 12 is a plan view depicting roof panels supported by the roof trusses of FIG. 10.

A gutter means may be provided by adding a hook 74 to the outermost end of each roof truss 70, and by providing a modular gutter member 76 having a complementally formed recess 78 formed therein as depicted for engagement therewith. A plan view of a structure having a few roof panels 72 and a few gutter pieces 76 installed is provided in FIG. 12. The construction of this first embodiment is complete when the remaining soffit panels, roof panels, and gutters are installed.

Figure 11A:
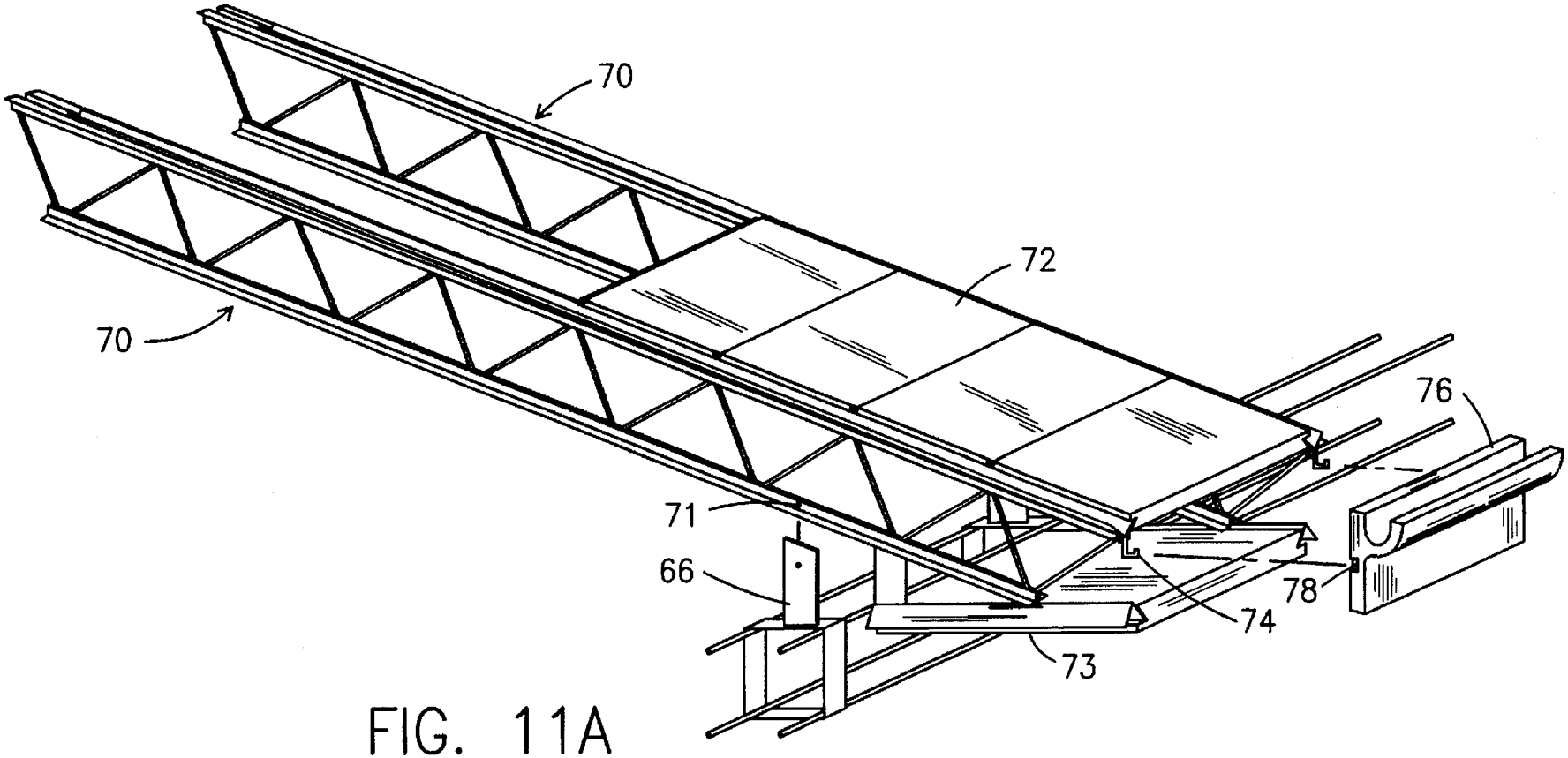
Figure 11B:
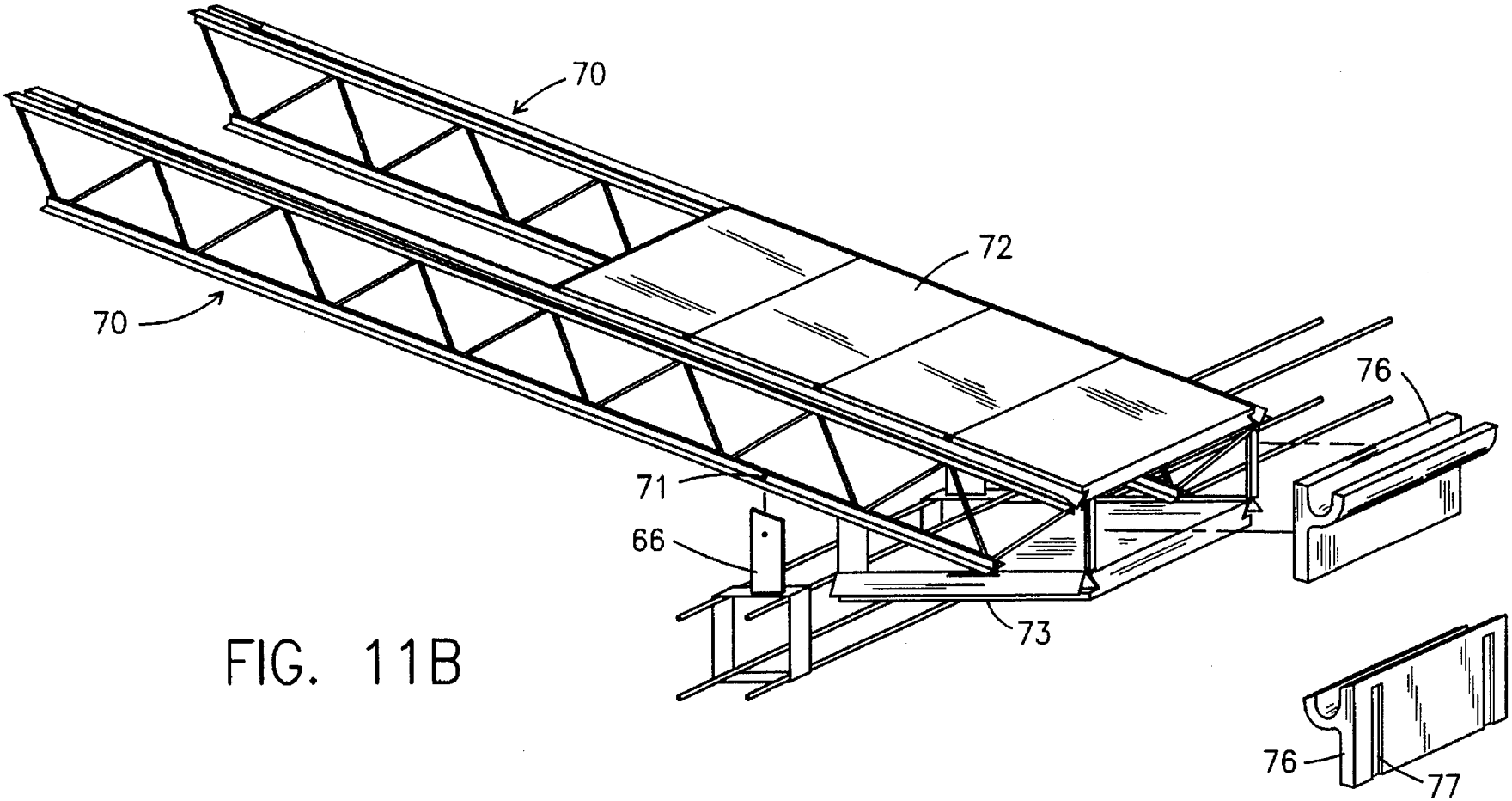

FIG. 11 depicts the roof structure of the first embodiment, whereas FIG. 11A depicts the roof structure of the second embodiment, disclosed in more detail hereinafter. As disclosed in FIG. 11B, each hook 74 may be supplanted by a "V"-shaped rail for engaging a dove tail-shaped groove 77 formed in a rear wall of each gutter section 76.

Figure 13:
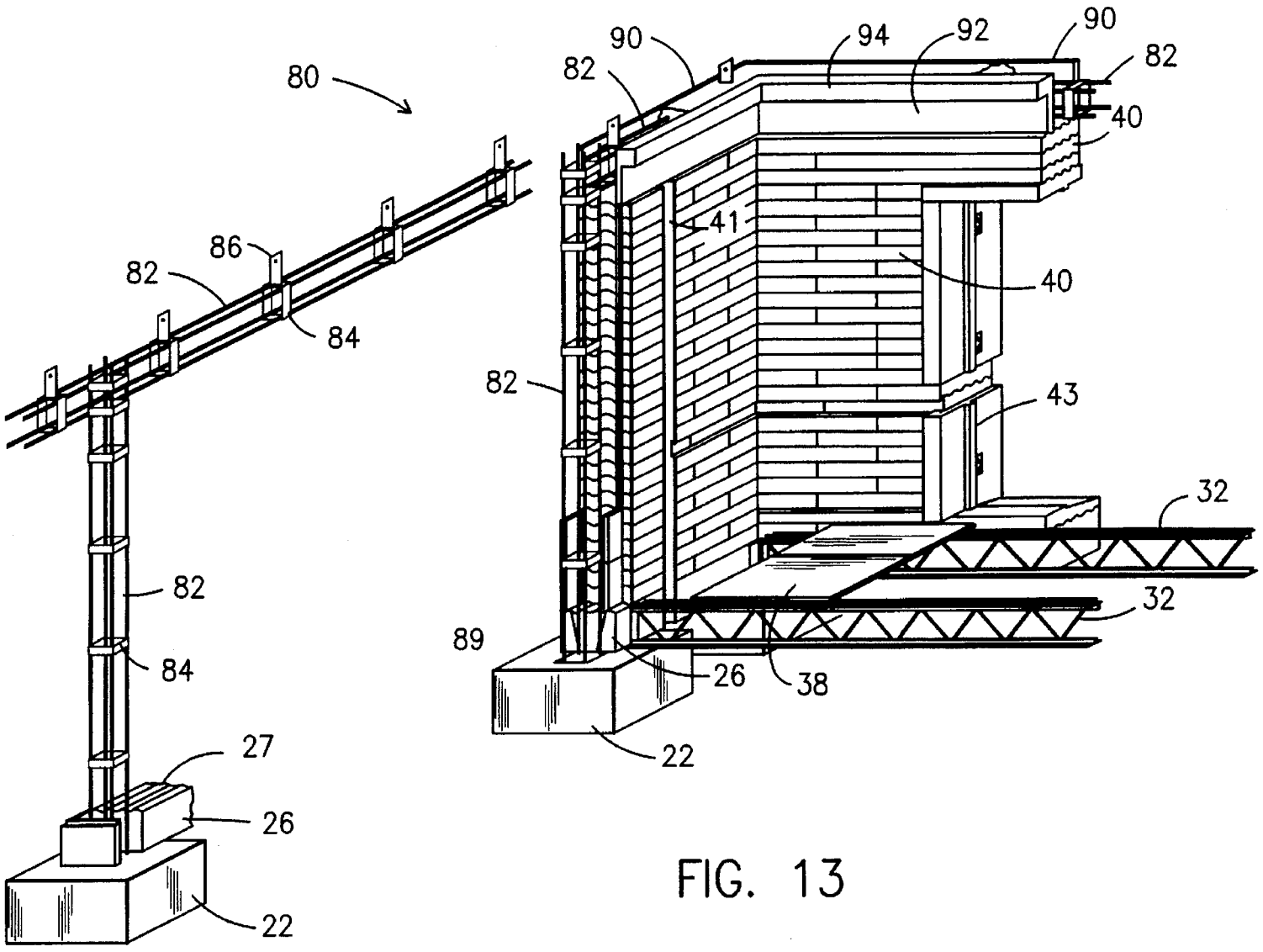
FIG. 13 is a perspective view of the structure of FIG. 1 when built in accordance with the second embodiment of this invention, said structure being disclosed at various stages of construction.

The second embodiment of the invention is depicted in FIG. 13 and is denoted 80 as a whole. This embodiment of the invention includes means for accommodating electrical and plumbing services, an improved anti-bending rod means 82, means for improving the roof of the structure, and means for providing an air conditioning duct. It also includes structural weight-bearing beams and columns so that the walls of the structure are essentially nonweightbearing.

Electrical wiring and pipes for plumbing are accommodated in this embodiment by recesses 41 and 43 formed in the interior surfaces of selected blocks 40. Recesses 41 collectively form a vertically extending space for said wires or pipes, and horizontal recess 43 that communicates with said vertical recess is formed by a horizontal recess formed in the interior surface of selected blocks 40.

The improved anti-bending rod means is denoted 82; it includes an assembly of rods banded together in a square pattern as shown by longitudinally spaced apart metallic straps or bands 84. The lowermost end of each assembly 82 is secured to anchor plate 88 that overlies or which is partially embedded within foundation block 22.

An upstanding mounting tab 86, having the same flat, apertured structure as tabs 66 of the first embodiment, is secured to each strap 84.

The roof structure is improved by eschewing angle members 60, 62 and interconnecting cross members 64 of the first embodiment. Instead, an elongate, flat weight-bearing concrete beam 90 is placed on its edge in surmounting relation to blocks 40 as depicted so that an exterior side of each beam 90 is flush with the exterior surface of blocks 40. An "L"-shaped, weight-bearing concrete beam 92 is placed atop said blocks on the interior edge thereof in slightly set back relation to the interior edge of said blocks 40 as shown. The amount of set back is equal to the extent of the overhanging or cantilever part 94 of member 92 so that the interior edge of said cantilever part 94 is flush with a vertical plane defined by the collective interior edges of blocks 40, i.e., the interior surface of part 94 is coplanar with the interior wall of the structure. Thus, when drywall or other suitable covering is placed over the interior surface of said blocks 40, an air conditioning duct is formed by the interior surface of said wall covering, the interior surface of member 92 and the lower surface of the cantilever part 94 of said member 92.

Concrete beams 90 and 92 also form a part of the improved roof construction. Collectively, beams 90 and 92 form an upwardly opening channel between them; a plurality of horizontally disposed tension assemblies 82 is placed within the channel formed by said beams as shown, in end-to-end relation with one another, and sufficient concrete is introduced into the channel to cover the tension members. More particularly, the channel is completely filled with concrete so that the concrete is flush with the uppermost edges of said beams 90 and 92 as depicted in FIG. 13.

Mounting tabs 86, having the same structure as mounting tabs 66 of the first embodiment, are positioned at equidistantly spaced intervals along the extent of each tension member 82, and roof trusses are affixed thereto as in the first embodiment. The roof panels and gutters of the first embodiment are also employed with this embodiment.

Figure 16:
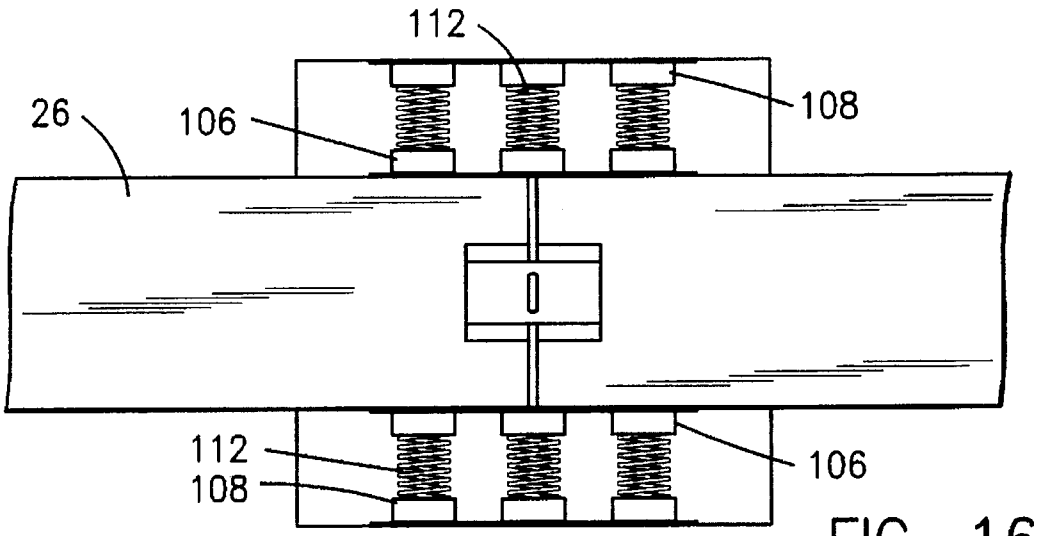
FIG. 16 is a perspective, simplified view of the structure depicted in FIGS. 14 and 15.
Figure 15:
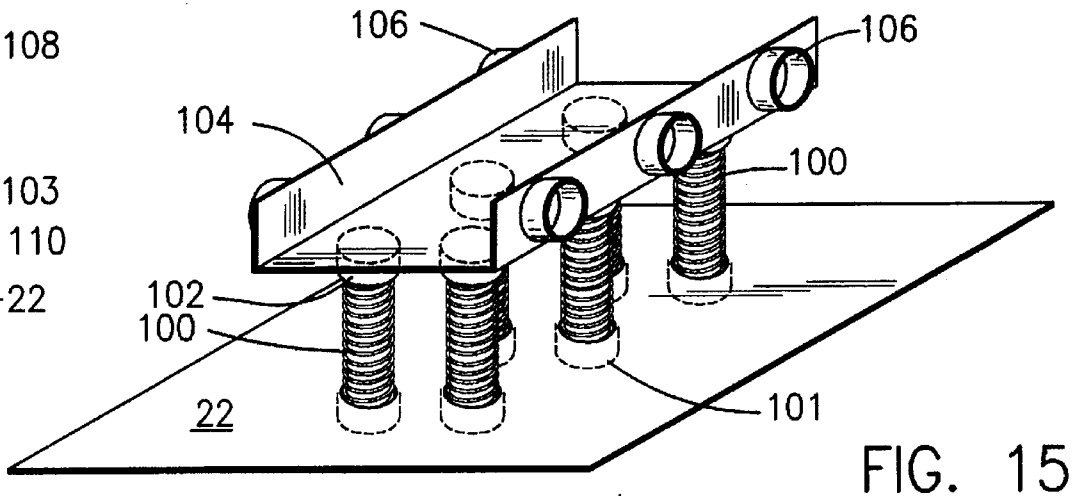
FIG. 15 is a top plan view of the structure depicted in FIG. 14.
Figure 14:
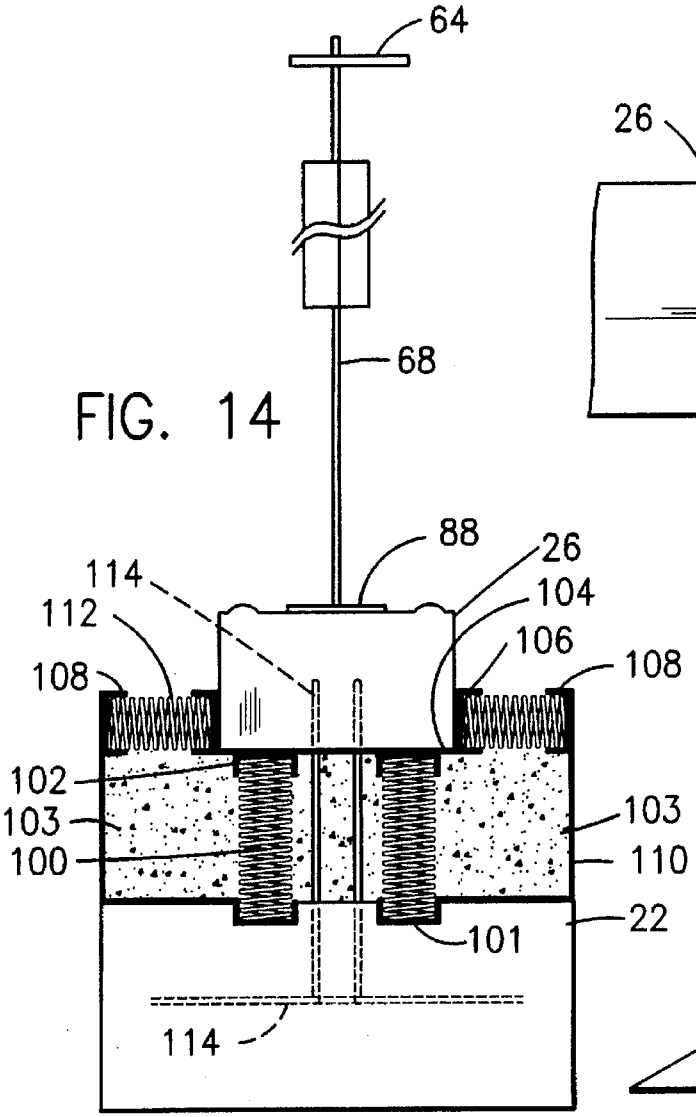
FIG. 14 is an end elevational view of an embodiment where the foundation blocks of FIG. 2 are separated from the foundation beams of FIG. 3 by shock absorbing means.

FIGS. 14–16 depict a means for cushioning shocks generated by earthquakes. FIG. 14 discloses that each foundation block 22 and its associated foundation beam 26 are separated from one another by a set of upstanding springs, collectively denoted 100, that are arranged in parallel relation to one another as perhaps best understood in connection with FIG. 15. The lowermost end of each spring 100 is positioned in a recess 101 formed in the top surface of said foundation block 22, and the uppermost end of each spring is contained within a housing 102 that depends from a channel 104 that is secured to the bottom surface of foundation beam 26. Spring housings 106 are secured to the exterior surface of the sidewalls of said channel 104, and spring housings 108 are secured to an interior surface of form 110. Accordingly, horizontal springs 112 are captured between said housings 106 and 108 as perhaps best understood in connection with FIG. 16. Note from FIG. 14 that springs 100 are embedded in light-in-weight concrete 103. Preferably, said concrete is a mixture of cement, polystyrene, and vermiculite; accordingly, it exhibits good shock-absorbing qualities. Thus, springs 100 and said concrete work together to dampen vertical shocks and springs 112 dampen horizontal shocks.

Note also in FIG. 14 the assembly of rod members, generally denoted 114, that joins together foundation block 22 and foundation beam 26.

This invention is not limited to the particular pattern of springs depicted. Moreover, the springs may be replaced by other means and the resulting structure would still be within the scope of this invention.

This invention is clearly new and useful. Moreover, it was not obvious to those of ordinary skill in this art at the time it was made, in view of the prior art considered as a whole as required by law.

This invention pioneers the art of buildings made with light-in-weight materials that exhibit good insulating properties and which are made without special tools and without mortar. Accordingly, the claims that follow are entitled to broad interpretation, as a matter of law, to protect from piracy the heart or essence of this breakthrough invention.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A method for constructing a floor for a building, comprising the steps of:

positioning a plurality of foundation blocks at predetermined locations that determine the building shape;

positioning a plurality of foundation beams in spanning relation to said foundation blocks;

forming a plurality of notches along an inner edge of preselected foundation beams at equidistantly spaced intervals along predetermined, opposing extents thereof;

inserting opposite ends of a plurality of floor trusses into a plurality of pairs of opposed notches, said floor trusses being disposed in parallel relation to one another and in bridging relation to said predetermined, opposing extents of said preselected foundation beams;

whereby said floor trusses are used in subsequent steps of the method to support a floor means for said building.

2. The method of claim 1, further comprising the step of forming each of said notches to have an open end flush with a top edge of its associated foundation beam and forming each of said notches to have a common, predetermined depth.

3. The method of claim 2, further comprising the step of proportioning each floor truss to have a depth equal to the depth of said notches so that uppermost edges of said floor trusses are flush with an uppermost top surface of said preselected foundation beams when said opposite ends of said floor trusses are disposed within said notches.

4. The method of claim 1, further comprising the steps of:

forming an elongate key uninterrupted along an uppermost edge of each of said floor trusses;

providing a flat, modular floor panel of predetermined thickness, said floor panel having a keyway formed in opposite sides thereof, each keyway being complementally formed with respect to the elongate key formed in each of said uppermost edges;

making a floor by sliding a plurality of said modular floor panels between each of said floor trusses so that the opposing sides of each panel are supported by contiguous floor trusses.

5. The method of claim 4, further comprising the step of:

interconnecting leading and trailing ends of each floor panel so that said panels interlock with one another at abutting leading and trailing ends when installed between said floor trusses.

* * * * *